US008161672B2

(12) United States Patent
Song

(10) Patent No.: US 8,161,672 B2
(45) Date of Patent: Apr. 24, 2012

(54) APPARATUS OF GENERATING MESSAGES

(76) Inventor: Ji-Yeon Song, Cambridge, MA (US)

( * ) Notice: Subject to any disclaimer, the term of this patent is extended or adjusted under 35 U.S.C. 154(b) by 176 days.

(21) Appl. No.: 12/740,427

(22) PCT Filed: Oct. 29, 2008

(86) PCT No.: PCT/KR2008/006376

§ 371 (c)(1),
(2), (4) Date: Apr. 29, 2010

(87) PCT Pub. No.: WO2009/057942

PCT Pub. Date: May 7, 2009

(65) Prior Publication Data

US 2010/0257764 A1 Oct. 14, 2010

Related U.S. Application Data

(60) Provisional application No. 61/000,812, filed on Oct. 29, 2007.

(51) Int. Cl.
*G09F 19/14* (2006.01)

(52) U.S. Cl. ..... 40/453

(58) Field of Classification Search ..... 40/453
See application file for complete search history.

(56) References Cited

U.S. PATENT DOCUMENTS 3,151,410 A * 10/1964 Stinis ..... 40/213
3,184,872 A * 5/1965 Way ..... 40/433
6,212,805 B1 * 4/2001 Hill ..... 40/443
6,606,396 B1 8/2003 Ishibashi et al.

FOREIGN PATENT DOCUMENTS

WO 2004102464 11/2004

OTHER PUBLICATIONS

PCT International Search Report dated Jun. 16, 2009, received in PCT Application No. PCT/KR2008/006376, 3 pgs.

PCT Written Opinion dated Jun. 16, 2009, received in PCT Application No. PCT/KR2008/006376, 3 pgs.

* cited by examiner

*Primary Examiner* — Joanne Silbermann
*Assistant Examiner* — Shin Kim
(74) *Attorney, Agent, or Firm* — Grossman Tucker Perreault & Pfleger, PLLC

(57) ABSTRACT

A message generating apparatus is disclosed. A message generating apparatus, comprising: a message generating panel, the message generating panel comprising a first layer and a second layer, the first layer comprising a first base substance and a first see-through pattern. a light transparency of the first see-through pattern being higher than a light transparency of the first base substance, the second layer comprising a second base substance and a second see-through pattern, a light transparency of the second see-through pattern being higher than a light transparency of the second base substance is provided. The message generating panel can be configured to generate a message by a light having passed through the first see-through pattern and the second see-through pattern. The first see-through pattern and the second see-through pattern can be configured to generate a plurality of messages according to an angle of the light incident to the message generating panel.

12 Claims, 31 Drawing Sheets

APPARATUS OF GENERATING MESSAGES

TECHNICAL FIELD

The present invention relates to an apparatus of generating messages using a panel in which a pattern is formed.

BACKGROUND ART

The present invention relates to an apparatus/structure which generates a message using a patterned panel.

Message generation by light has been used for shadow toys and image projector using a slide film. For image projection a silhouette is represented by illuminating a pattern. In a theater, a message in a movie is generated by projecting a film to a screen.

Single frame of slide film or movie film corresponds to a single image. Thus, substitution of a slide film is required for representing a different image. For a movie, a moving picture is generated by projecting several images per a second. A change in incident angle of light can change projected position of a image but does not bring essential change in the projected image.

According to an embodiment of the present invention, a message generating apparatus representing different messages according to different incident angles of illumination is disclosed. This apparatus structure can be realized by combining plural layers.

DISCLOSURE OF INVENTION

Technical Problem

One aspect of the invention is to provide a message generating apparatus including a first panel and a second panel, the first panel transmits a incident light partially according its pattern and the second panel transmits the light passed through partially according to its pattern.

One aspect of the invention is to provide a message generating apparatus to generate different messages according to the incident angle of a light, by a inclined see-through pattern on a panel.

One aspect of the invention is to provide an apparatus to generate a message which corresponds to a relative arrangement of a cover panel and a message pattern panel.

Technical Solution

According to an embodiment of the present invention, a message generating apparatus can comprise a message generating panel. The message generating panel can comprise a first layer and a second layer. The first layer can include a first base substance and a first see-through pattern which has a higher light transparency than the first base substance. The second layer can include a second base substance and a second see-through pattern which has a higher light transparency than the second base substance. The message generating panel can be configured to generate a message by a light which passed the first see-through pattern and the second see-through pattern. The message generating panel can represent plural message which corresponds to incident angle of a light to the message generating panel.

the second see-through pattern of the message generating panel can include a first sub see-through pattern corresponding to a first message and a second sub see-through pattern corresponding to a second message.

The message generating panel can generate the first message by using a light passed though the first see-through pattern, incident to the first layer in a first direction to the first layer. The message generating panel can generate the second message by a transmitted light through the first sub see-through pattern, incident to the first layer in a second direction. This message projection of the message generating panel can be realized by controlling relative arrangement between the see-through pattern of the first layer and the see-through pattern of the second layer.

Each layer of the message generating panel can be formed with a base substance in a plate shape. The layer may not be flat and a layer with a curved surface can be used to constitute the message generating panel.

The see-through pattern can include holes penetrating a layer of the message generating panel. These through hole, in general, can be formed in a perpendicular direction to a surface of plate shape layer. In case, a through hole is inclined by a predetermined angle from the surface of the layer of the message generating panel, It can be result in a similar consequence to a inclined layer a with perpendicular through hole. The message generating panel including a layer of inclined through holes can be utilized in a circumstance which does not allow a inclined layer set up.

The message generating apparatus can include plural message generating panels. The plural message generating panels can have different postures to correspond to different illumination directions. When a message generating apparatus is set up in outdoor space, a light source can be a artificial light source or a natural light source (the sun or the moon) and, for the efficiency of message generation, longitude information, latitude information and meridian altitude information of the sun at the set up location can be utilized.

According to a embodiment of the present invention, the message generating apparatus can produce a message by overlapping a cover layer and a base layer. The base layer can include plural message patterns. Regions occupied by the plural message patterns, namely closed loops of the message patterns, can be coincide with each other. In this case, information of the message patterns may not be read easily.

A message corresponding to each message pattern can be read by overlapping the cover layer on the base layer on which the plural message patterns are formed. The cover layer and the base layer can represent distinct messages in plural overlapping modes. The plural overlapping mode can be realized by change relative arrangement of the layers.

The base layer can include a first message pattern and a second message pattern. The first message pattern can be exposed through the first see-through pattern of the cover layer, in a first overlapping mode of the message generating panel. The second message pattern would be exposed through the first see-through pattern of the cover layer in a second overlapping mode of the message generating panel. Each overlapping mode corresponds to different relative arrangement between the cover layer and the base layer.

In each overlapping mode of the message generating apparatus which includes plural message generating panels, a generated message can be a part of a target message (sentence or phrase). A user can read each part of the target message by moving the message generating panel.

To introduce overlapping mode conversion of a message generating panel, the cover layer and the base layer can include a guide pattern to guide/limit the relative movement of the two layers. This guide pattern can be a through hole of the two layers. a coupling device can be applied to coupling each guide pattern of the two layers.

Additional aspects and advantages of the present invention will be set forth in part in the description which follows, and in part will be obvious from the description, or may be learned by practice of the invention.

MODE FOR INVENTION

Embodiments of a method of apparatus of generating message according to certain aspects of the invention will be described below in more detail with reference to the accompanying drawings. However description of the embodiments is not to limit the present invention to a certain embodiment. The description of the embodiments can be understood to include all conversions, equivalents and alternatives. In case a detail description of a related prior art may blur a point of the present invention, the detail description can be omitted. Also, in the description with reference to the accompanying drawings, those components are rendered the same reference number that are the same or are in correspondence regardless of the figure number, and redundant explanations are omitted.

Figure 1:
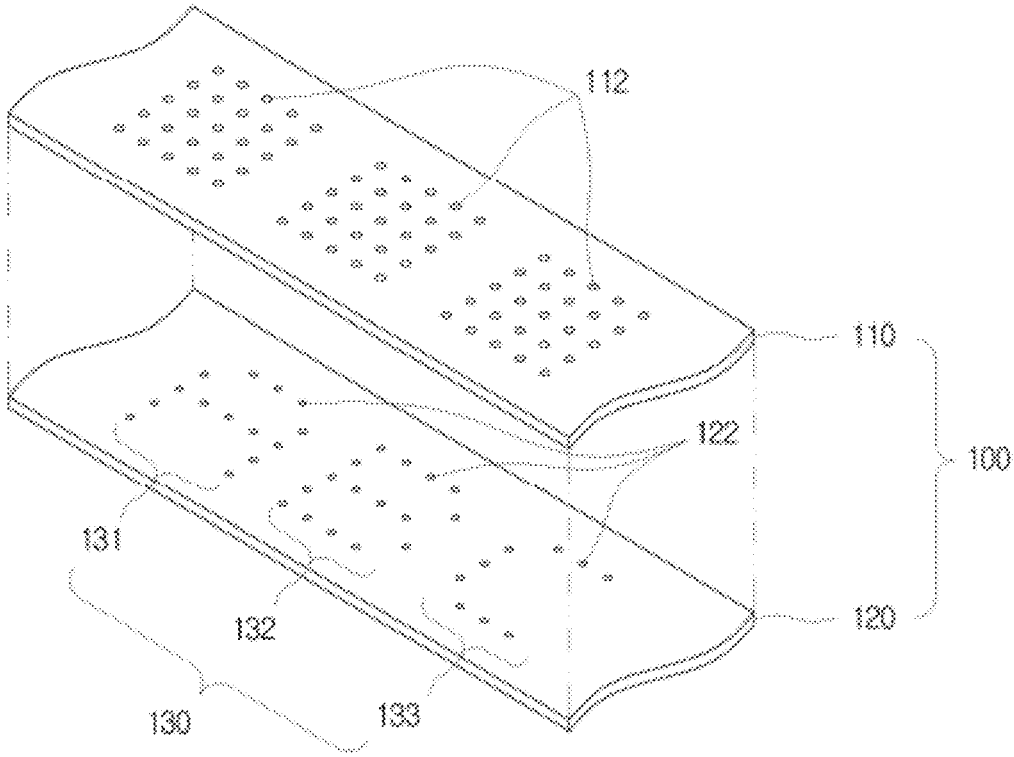
FIG. 1 illustrates a message generating panel for a message generating apparatus according to an embodiment of the present invention.
Figure 2:
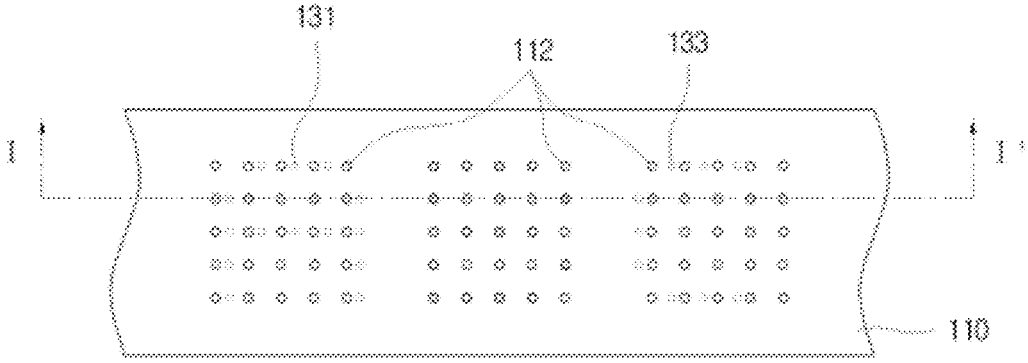
FIG. 2 is a plan view of the message generating panel illustrated in FIG. 1.

FIG. 1 illustrates a message generating panel for a message generating apparatus according to an embodiment of the present invention. FIG. 2 is a plan view of the message generating panel illustrated in FIG. 1.

In case a message generating panel (100) is illuminated, a light passed through the message generating panel (100) generates a relatively bright pattern in a shadow of the message generating panel (100). The bright pattern can represent a message. Shape of the bright pattern can be change according to passing through characteristics of the message generating panel (100). The passing through characteristics of the message generating panel (100) can be controlled by adjusting shape and position of a see-through pattern of the message generating panel (100). Thus, the message generated by the message generating panel (100) can be modified by modifying the see-through pattern formed in the message generating panel (100).

A first layer (110) and a second layer (120) can be a layer of opaque substance for visible light. For an example, plastic, wood, paper and metal etc. can be used for the first layer (110) and the second layer (120). Because The first layer (110) and the second layer (120) are opaque, a part of light incident to each layer can pass through the layer. Meanwhile, a message projection panel can be made by printing an opaque pattern on a glass or a transparent plastic.

In FIG. 1, the message generating panel (100) includes the first layer (110) and the second layer (120). The first layer (110) is an outer layer to which an illumination is incident. The first layer (110) can include a first see-through pattern (112) with through holes penetrating the layer. The through holes of the first layer (110) forms 5×5 grids. The second layer (120) also includes through holes penetrating the layer. The through holes (122) of the second layer (120) can forms a message patterns (130). A first message pattern (131), a second message pattern (132) and a third message pattern (133) can represent alphabet letter A, B and C respectively.

In FIG. 2, because the second layer (120) is under the first layer (110), a message pattern on the second layer (120) can hardly be readable from first layer side.

In FIG. 2, for the convenience of description, each message patterns (130) are separated spatially from each other on the second layer (120). The message patterns (131, 132, 133) can be overlapped on the second layer (120). In this case, message patterns (131, 132, 133) representing alphabet letter A, B and C can be overlapped spatially on the second layer (120) and direct message reading from the second layer (120) can be difficult.

Furthermore, in case an additional dummy pattern (not shown) which does not generate a message is formed on the second layer (120), message pattern reading from the second layer (120) gets much harder. By using a dummy pattern, the message generating panel (100) may not expose a message from a single layer of the panel.

The second layer (120) is an inner layer to which a light passed the through holes of the first layer (110) is incident. A part of the light reached the second layer can be blocked and the other part of the light can pass through through holes of the second layer (120) and generate a message.

Passing through characteristics by geometric structure of the message generating panel (100) and a generated message will be described referring to FIG. 3 and FIG. 4.

Figure 3:
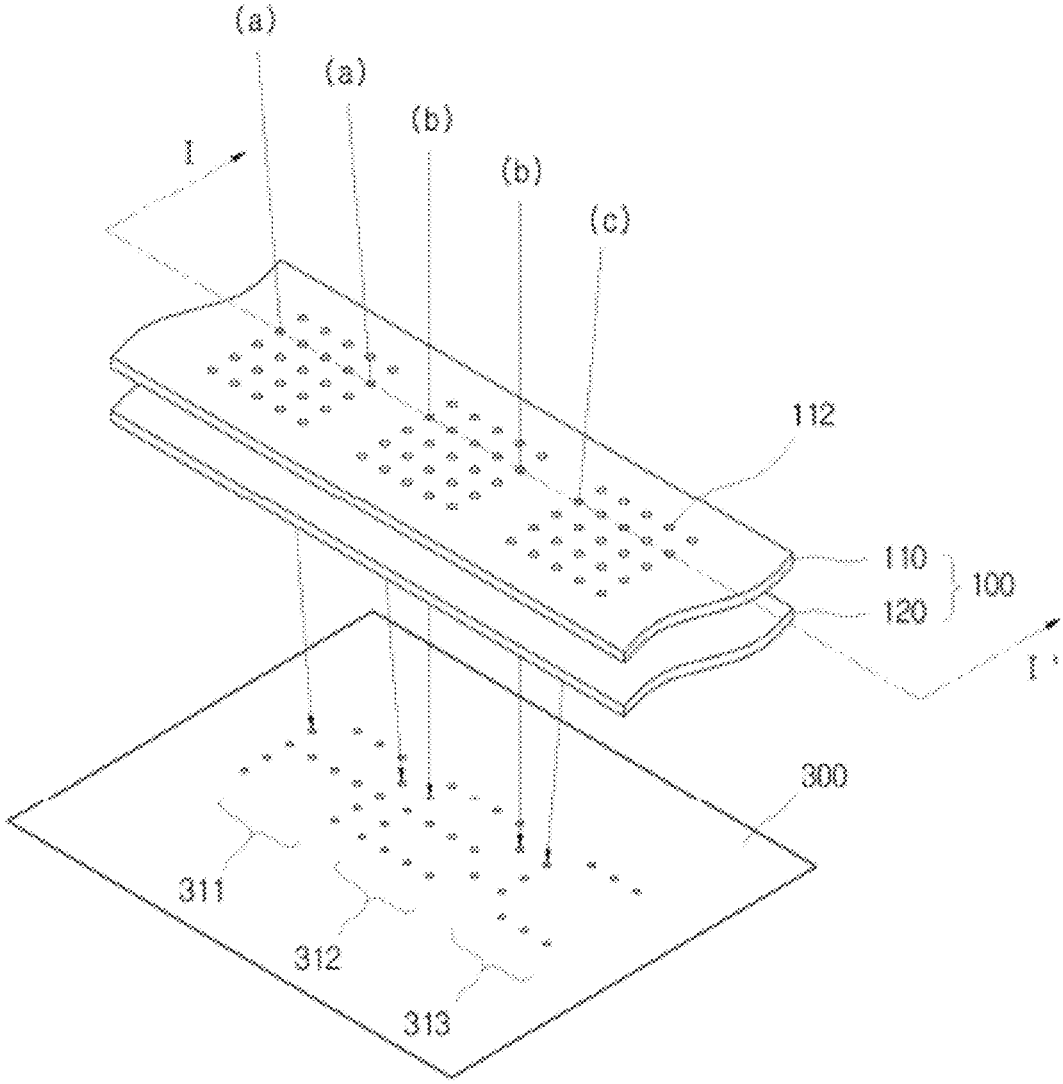
FIG. 3 is illustrates messages projected by lights in different directions incident to a message generating panel according to an embodiment of the present invention
Figure 4:
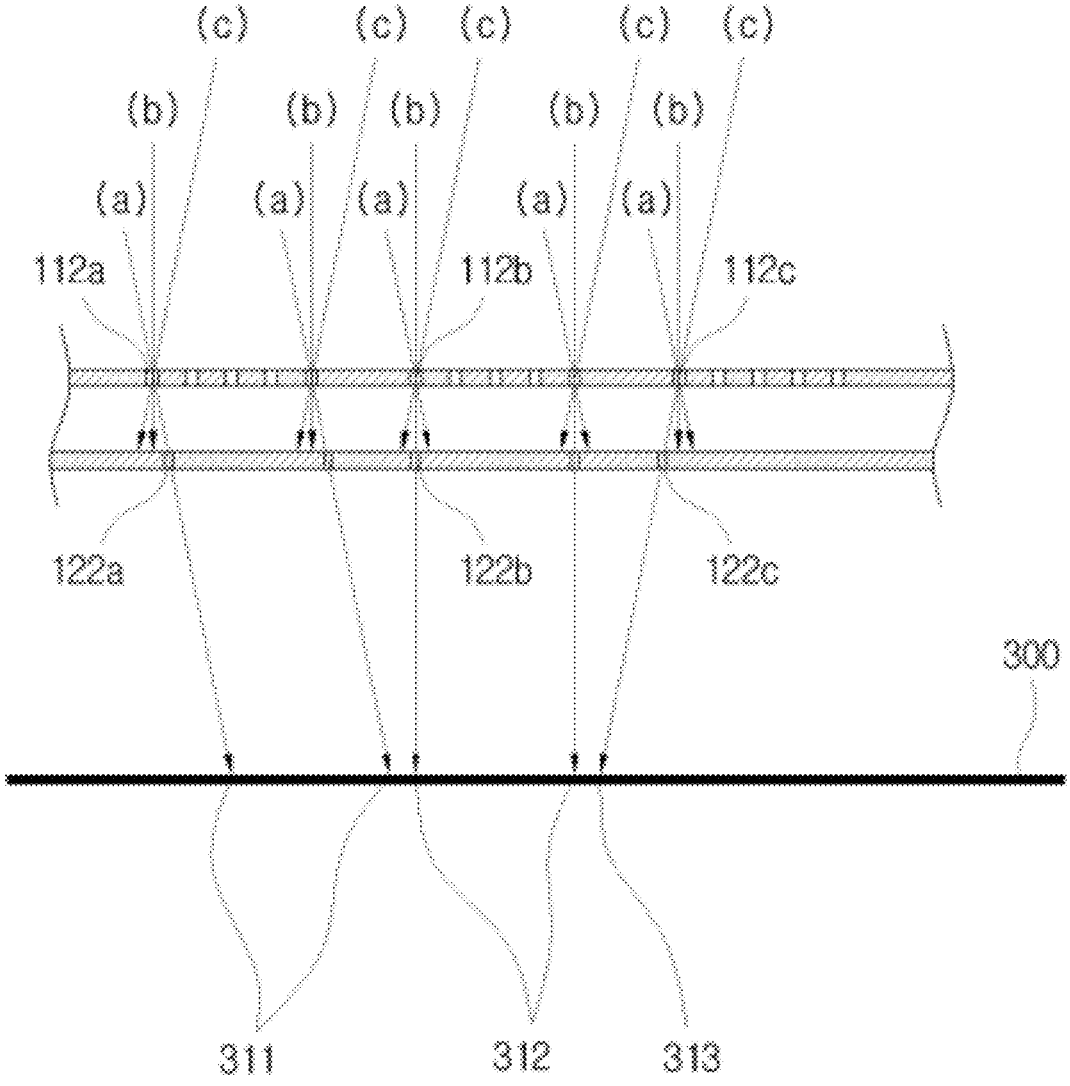
FIG. 4 illustrates a cross-section of the message generating panel in FIG. 3 and passing through characteristics of lights according to incident angles.

FIG. 3 is illustrates messages projected by lights in different directions incident to a message generating panel according to an embodiment of the present invention FIG. 4 illustrates a cross-section of the message generating panel in FIG. 3 and passing through characteristics of lights according to incident angles.

Referring to FIG. 3, lights in 3 different direction are incident to the message generating panel (100), light in each direction represent three alphabet letter messages (311, 312, 313) correspondent to message pattern on the second layer (120) on a screen (300). A light in (a) direction can pass through the through holes of the first message pattern (131) of the second layer (120). A message A (311) is projected on the screen (300) by the light in (a) direction which passed the through holes of the first message pattern (131) of the second layer (120). The light in (b) direction can pass through the first layer (110) and the second message pattern (132) of the second layer (120). A message B (312) is projected on the screen (300) by the light in (b) direction. the light in (c) direction can pass through the third message pattern (133) of the second layer (120). A message C (313) can be projected on the screen (300) by the light in (c) direction.

Referring to FIG. 4, a cross-section of the message generating panel (100) in (I-I') illustrated in FIG. 2 are shown. Lights in (a), (b) and (c) direction are incident to the first layer (110) of the message generating panel (100). A light in (a) direction of the lights in 3 directions which passed a first through hole (112*a*) of the first layer (110), can only reach the screen (300) through a first through hole (122*a*) of the second layer (120). Lights incident to the first through hole (112*a*) in (b) and (c) direction may be blocked by the second layer (120). The first through hole (122*a*) of the second layer (120) can be passed through only by the light in (a) direction among the lights in three directions. Among the lights that passed the first layer (110), the light in (a) direction can only pass through a through hole of the first message pattern (131) corresponds to alphabet letter A of the second layer (120). The alphabet letter A (311) projected on the screen is generated by the light in (a) direction.

Among the lights in three directions which passed a second through hole (112*b*) of the first layer (110), the light in (b) direction can only pass through a second through hole (122*b*) of the second layer (120). The through hole of the second message pattern (132) of the second layer (120) can be passed through only by the light in (b) direction among the lights in three directions. The light in (b) direction can generate a message (312) of a alphabet letter B on the screen (300).

Among the lights in three directions which passed a third through hole (112*c*) of the first layer (100), the light in (c) direction can only pass through a third through hole (122*c*) of the second layer (120). The through hole of the third message pattern (133) on the second layer (120) can be passed through only by the light in (c) direction among the lights in three directions which incident to the message generating panel (100). The light in (c) direction which passed through the third message pattern (133) can represent a message (313) corresponds to a alphabet letter C on the screen (300).

As mentioned above, a message generated by the message generating panel (100) can be changed according to an incident angle of a light to the message generating panel (100). According to an embodiment of the present invention, the message generating panel (100) can generate a message selectively among messages which are correspondent to the plural message patterns (131, 132, 133) of the second layer (120) according to illumination condition.

In case, the message generating panel is illuminated by sun light, different messages can be represented according to incident angle of the sun light which changes during day time. In case, the three lights in (a), (b), (c) direction correspond to sun light in morning, noon, afternoon respectively, the message generating panel (100) can generate the three messages—A, B, C in turn during day time.

Meanwhile, the message patterns (130) of the second layer in the message panel in this embodiment can be passed by a light in one direction among the lights in three directions. But, a through hole of a message pattern of a message generating panel can be configured to be passed thorough by lights in more than two directions. With this message pattern which can be passed by lights in plural directions, a message gradually changing according to the incident angle of the lights.

The configuration of the message generating panel can be modified by controlling diameter of the through hole, shape of the through hole, thickness of the layer, relative position of the layers of the message generating panel.

Figure 5:
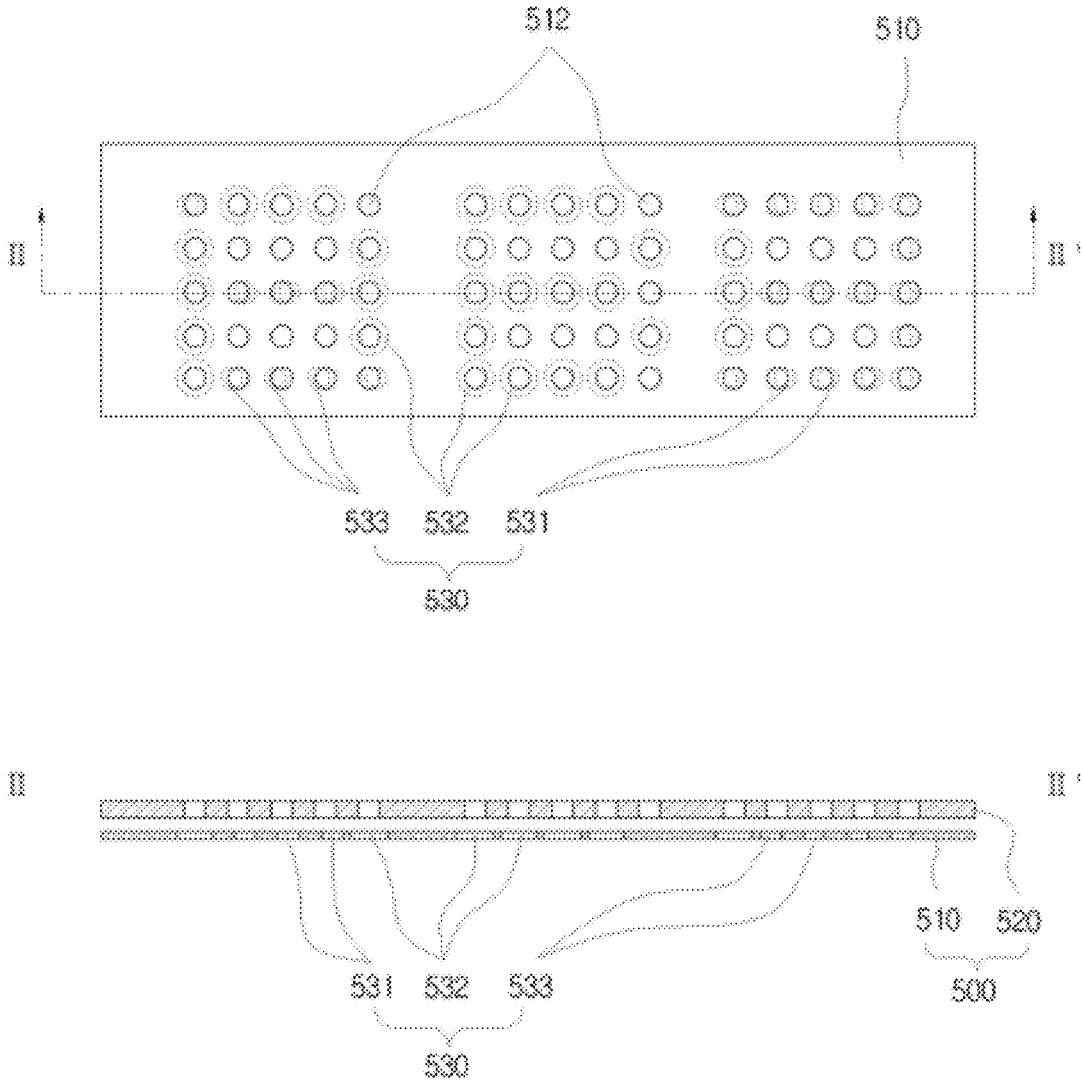
FIG. 5 illustrates a plan view and a cross-sectional view of a message generating panel according to an embodiment of the present invention.
Figure 6:
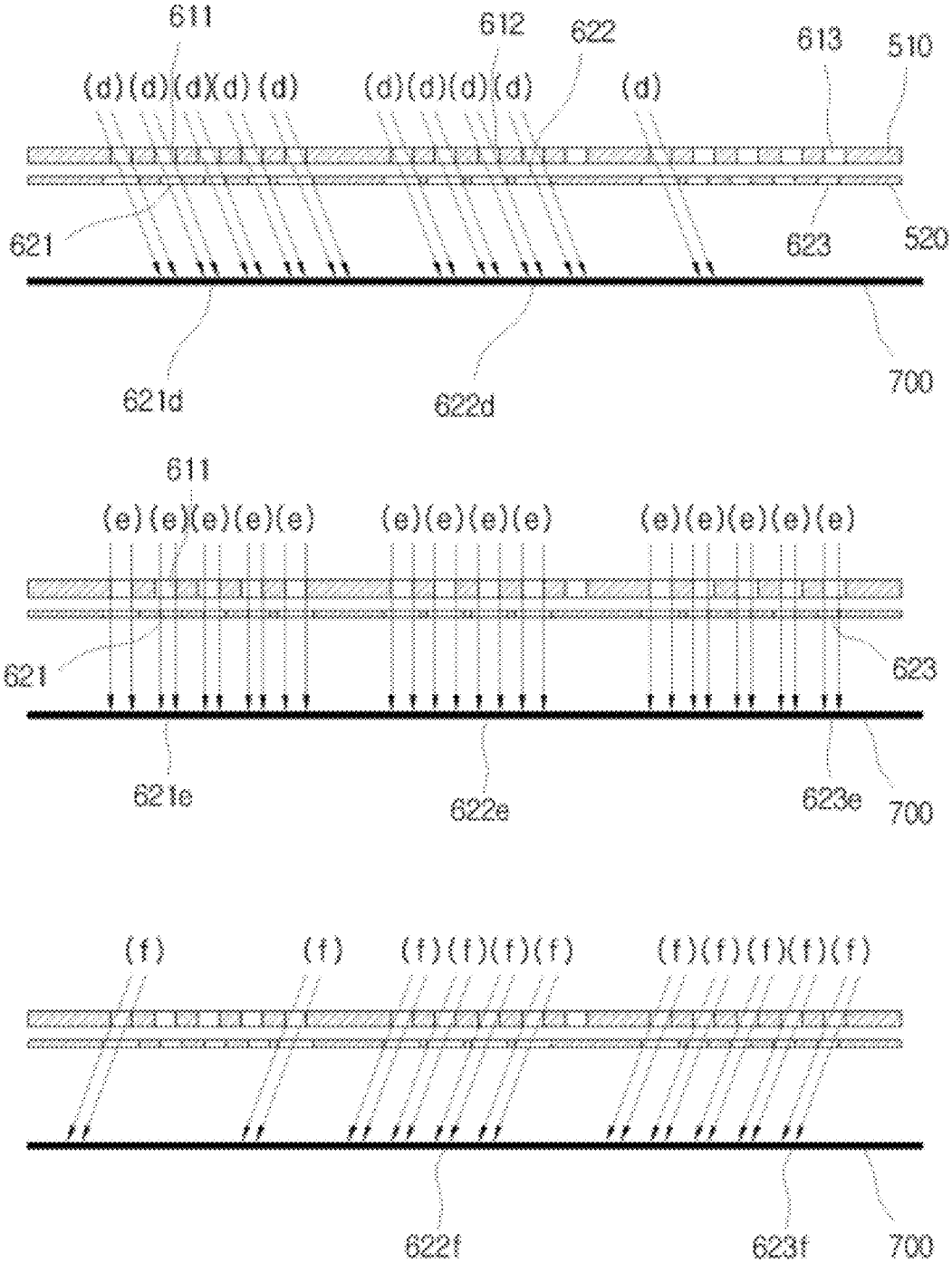
FIG. 6 illustrates passing through characteristics of message generating panel in FIG. 5 according to illumination directions.
Figure 7:
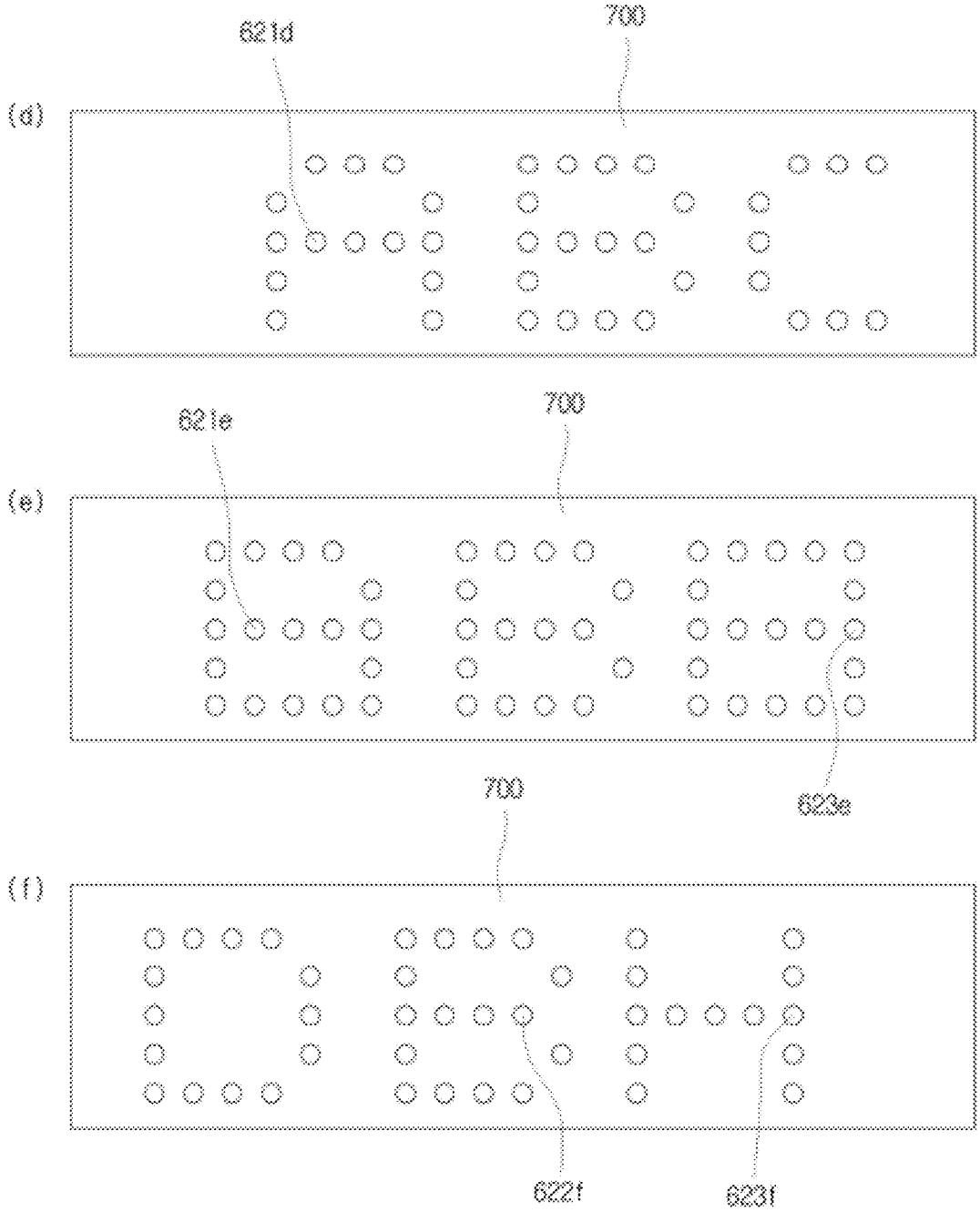
FIG. 7 illustrates messages formed by lights having pass through the message generating panel in FIG. 5 according to illumination directions illustrated in FIG. 6.

FIG. 5 illustrates a plan view and a cross-sectional view of a message generating panel according to an embodiment of the present invention. FIG. 6 illustrates passing through characteristics of message generating panel in FIG. 5 according to illumination directions. FIG. 7 illustrates messages formed by lights having pass through the message generating panel in FIG. 5 according to illumination directions illustrated in FIG. 6.

Referring to FIG. 5, a message generating panel (500) includes a first layer (510) and a second layer (520). The first layer (510) and the second layer (520) includes through holes formed in an opaque base substance. Trough holes on the first layer (510) forms a through pattern (512) in a grid shape and the pattern itself does not teach any particular message. Trough holes on the second layer also forms a through pattern (530). The through pattern (530) includes three sub patterns (531, 532, 533). Each of the sub patterns (530) can have different relative displacements from the grid pattern (512) of the first layer (510). Difference in displacements from the grid pattern (512) of the first layer (510) can result in different passing through characteristics of each sub pattern.

Referring to FIG. 6 and FIG. 7, passing through characteristics of the message generating panel (500) and messages projected on the screen (700) by the panel (500).

Referring to FIG. 6, lights in (d), (e), (f) direction are incident to the message generating panel (500). A through hole (621) of the first sub pattern (531) of the second layer (520) transmits the (d) direction and (e) direction light and does not transmits the (f) direction light. The (d) direction and (e) direction lights passed through the through hole (621) of the first sub pattern (531) are projected on the screen (700) and represents a bright spots (621*d*, 621*e*).

A through hole (622) of the second sub pattern has a same central axis as the through hole (612) of the grid pattern of the first layer. Diameter of through hole (622) of the second sub pattern is larger than the diameter of through holes (621, 623) of the first sub pattern and the third sub pattern. The second sub pattern can transmits all three (d), (e), (f) direction lights. The three direction lights passed the through hole (622) are projected to the screen and represents bright spots (622*d*, 622*e*, 622*f*) in the shadow of the message generating panel.

A central axis of a through hole (623) of the third sub pattern is located on the left of a central axis of a through hole (613) of the grid pattern of the first layer which corresponds to the through hole (623). The through hole (623) of the third sub pattern transmits (e) and (f) direction light and does not transmits the (d) direction light. The light in two direction transmitted through the through hole (623) can be projected to the screen and represents bright spots (623*e*, 623*f*) in shadow of the message generating panel.

Referring to FIG. 7, messages projected on the screen by the lights in three direction—(d), (e), (f) are shown. The message by (d) direction light is 'ABC' and the message by (f) direction light is 'DBH'. The message by (e) direction light is a combined of the message 'ABC' and 'DBH'. While the direction of the light change gradually from (d) to (f), the change in the message can be taken gradually. For a fixed screen (700), the message projected position in the screen can be changed gradually. This gradual change can be realized by the second sub pattern which corresponds to a common part of the message 'ABC' by the (d) direction light and the message 'DBH' by (f) direction light.

By adjusting size of through hole in the message generating panel, brightness and duration of projected message by the message generating panel can be controlled. In case, the three lights in (d), (e), (f) direction correspond to sun light in morning, noon, afternoon, duration of message projected by the second sub pattern (532) of the message generating panel can be the longest.

Figure 8:
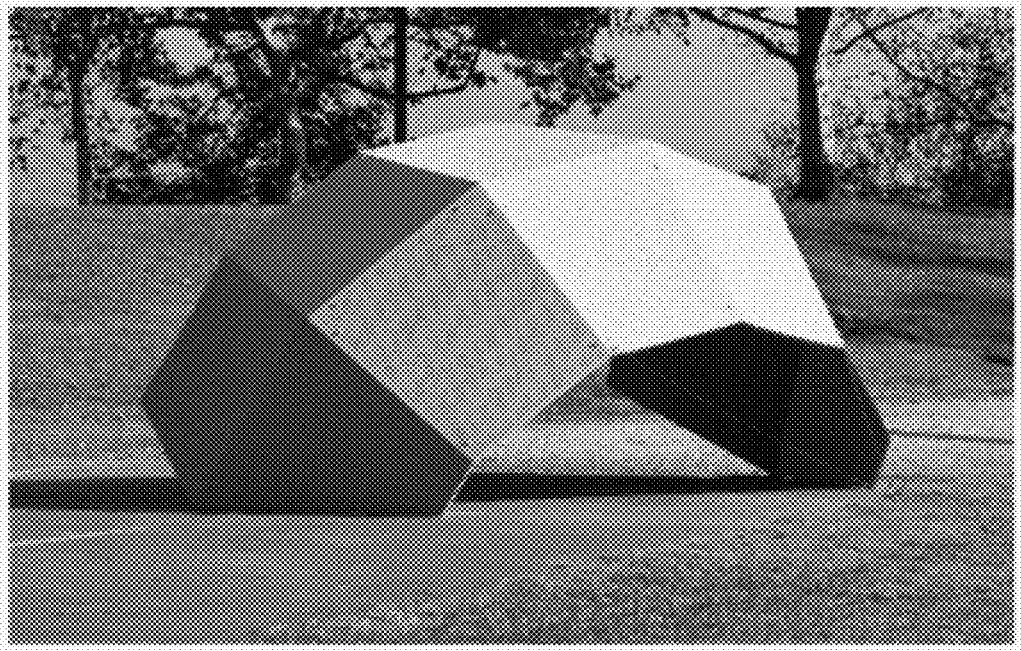
FIG. 8 illustrates a message generating apparatus installed at an outdoor space according to an embodiment of the present invention.
Figure 9:
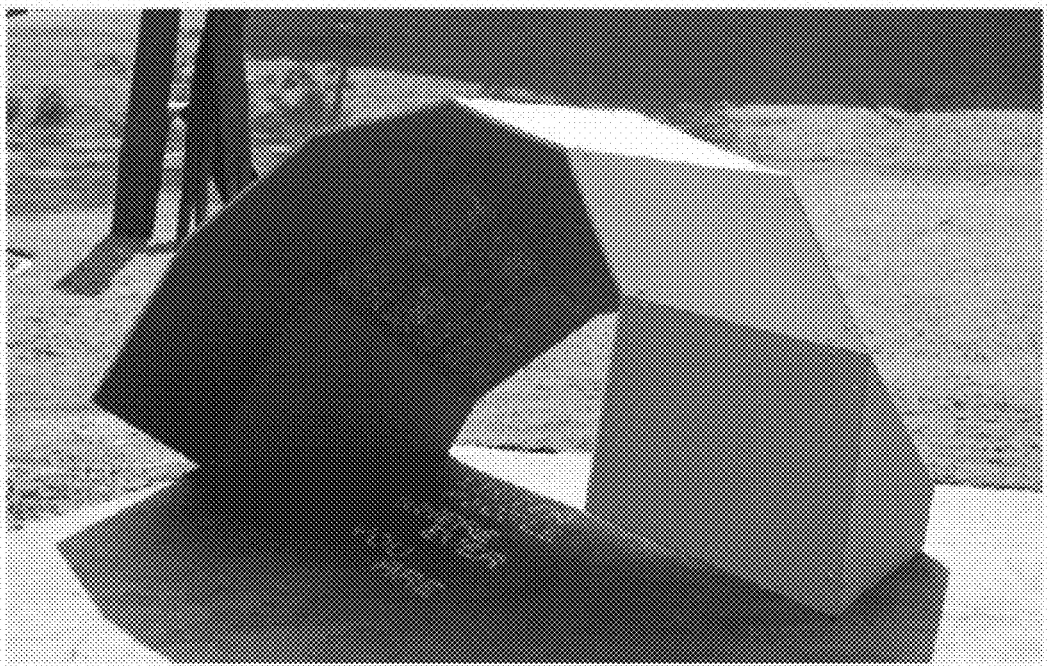
FIG. 9 illustrates a message generates by the message generating apparatus and its shadow in FIG. 8.
Figure 10:
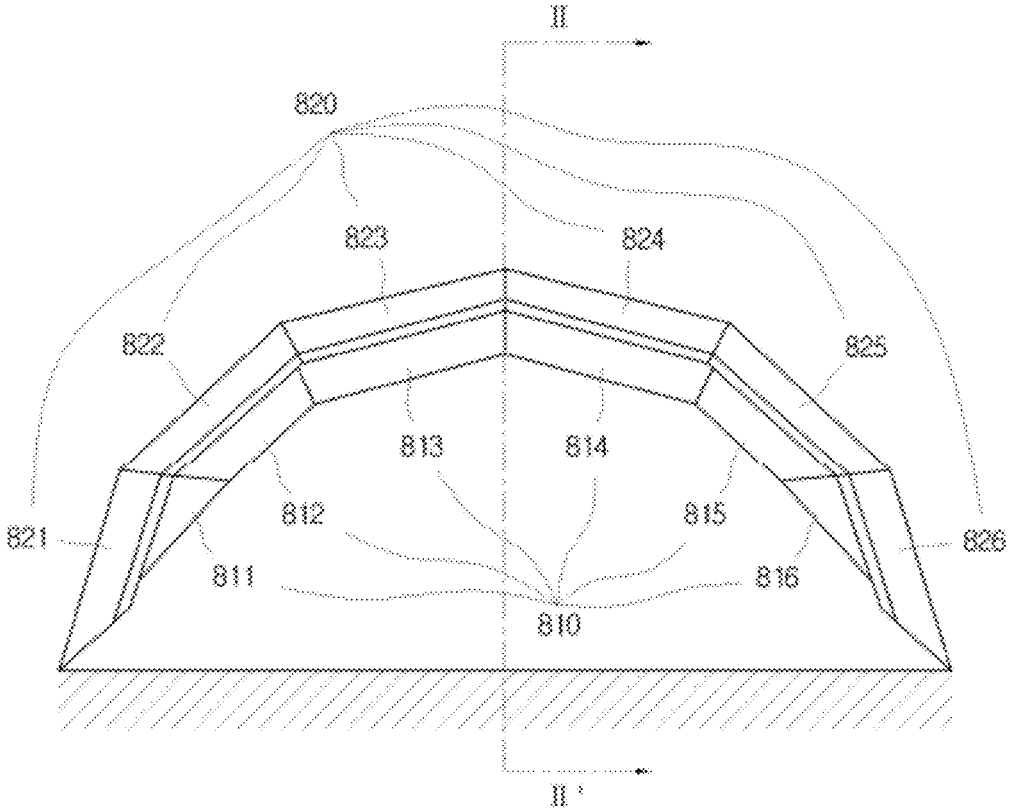
FIG. 10 illustrates front view and cross-sectional view of the message generating apparatus in FIG. 8 and FIG. 9.
Figure 10:
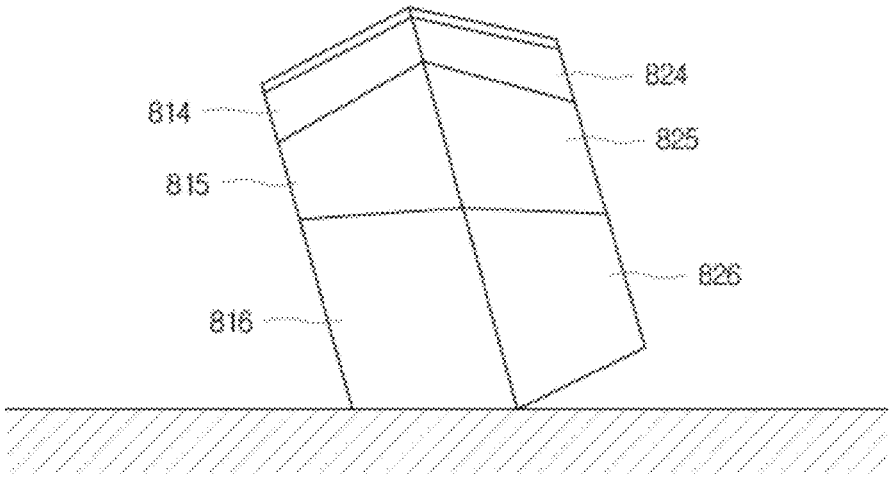

FIG. 8 illustrates a message generating apparatus installed at an outdoor space according to an embodiment of the present invention. FIG. 9 illustrates a message generates by the message generating apparatus and its shadow in FIG. 8. FIG. 10 illustrates front view and cross-sectional view of the message generating apparatus in FIG. 8 and FIG. 9.

Referring to FIG. 8, a message generating apparatus can include 12 panels. The 12 panels can be grouped into 2 panel bands each including 6 panels. In an outer layer of a message generating panel of the message generating apparatus, a grid of uniformly arranged through holes. Thus, as in FIG. 8, a message to be generated by the message generating apparatus may not be read by observation from outside.

Referring to FIG. 9, a message is projected on the ground by a sun light incident to the message generating apparatus. In FIG. 9, the message is projected to the ground without a screen. Different message generating panels can produce a message on the ground for each time band. In the morning, the sun light can produce through a message generating panel facing east. In the afternoon, a message can be produced by a message generating panel facing west.

Referring to FIG. 10, the message generating apparatus can include two panel band (810, 820). Because a range of incident angle of light in which a single message generating panel can generate a message effectively can be limited, the message generating apparatus can include plural message generating panels.

A first panel band (810) includes six panels (811, 812, 813, 814, 815, 816). The first panel band (810) can generate a message by a light from the sun at a relatively low altitude. Because, the meridian altitude of the sun in winter is relatively low, the first panel band will generate a message effectively during the winter.

A second panel band (820) includes six panels (821, 822, 823, 824, 825, 826). The second panel band can generate a message by a light from the sun at a relatively high altitude. the second panel band will generate a message effectively in the summer when the sun has a high meridian altitude.

Figure 11:
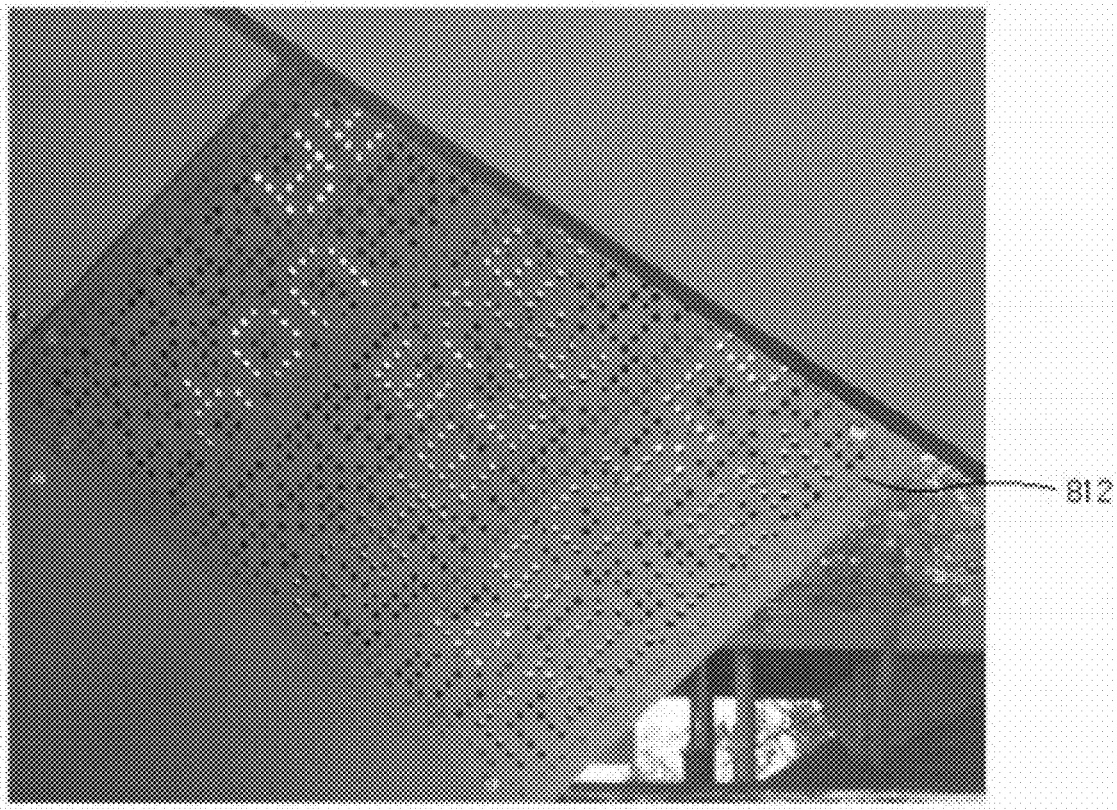
FIG. 11 illustrates a message generating panel shown from inside of the message generating apparatus illustrated in FIGS. 8 to 10.

FIG. 11 illustrates a message generating panel shown from inside of the message generating apparatus illustrated in FIGS. 8 to 10.

Figure 12:
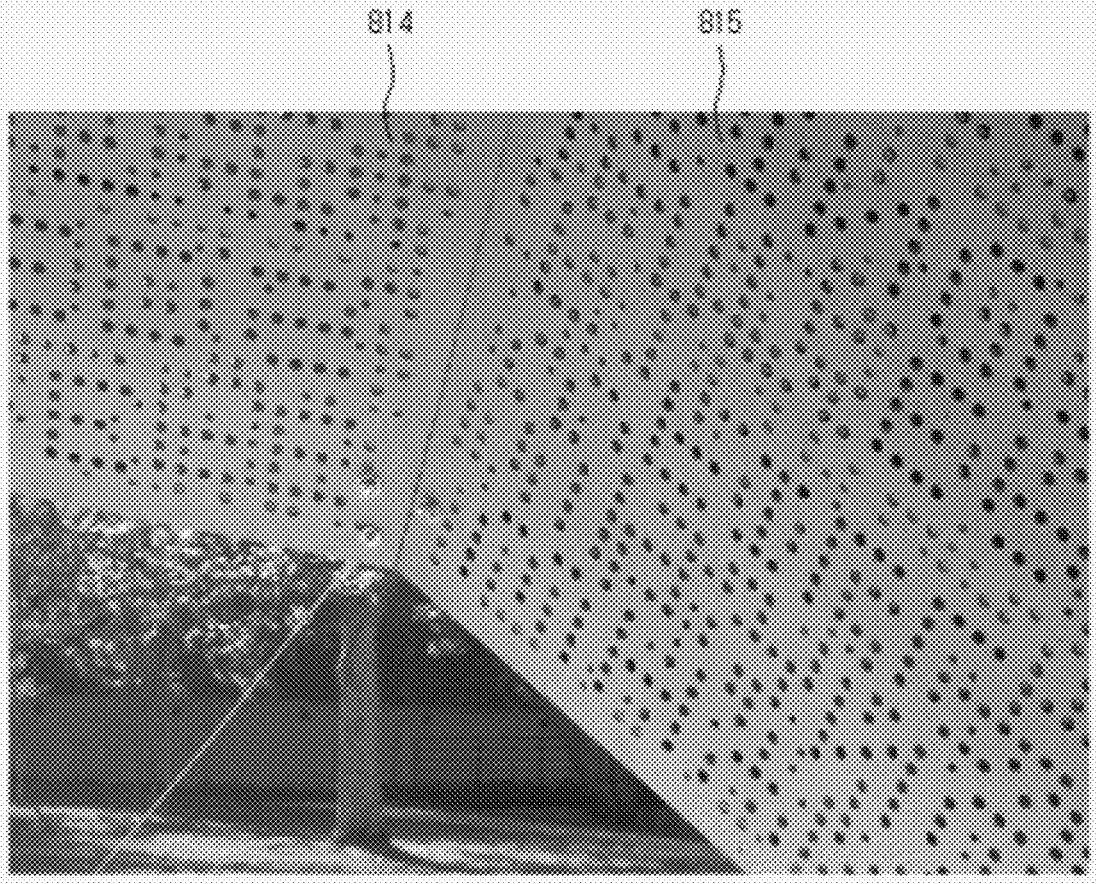
FIG. 12 illustrates a message generating panel shown from inside of the message generating apparatus illustrated in FIGS. 8 to 10.

Referring to FIG. 11, there are shown an inner layer of the message generating panel (812) of the message generating apparatus. In FIG. 11, a part of the message to be generated by the message generating panel (812) can be read in especially taken photograph on the light path that penetrates the panel. But in general, message reading is not possible from the inner layer of the message generating panel as in FIG. 12.

Figure 13:
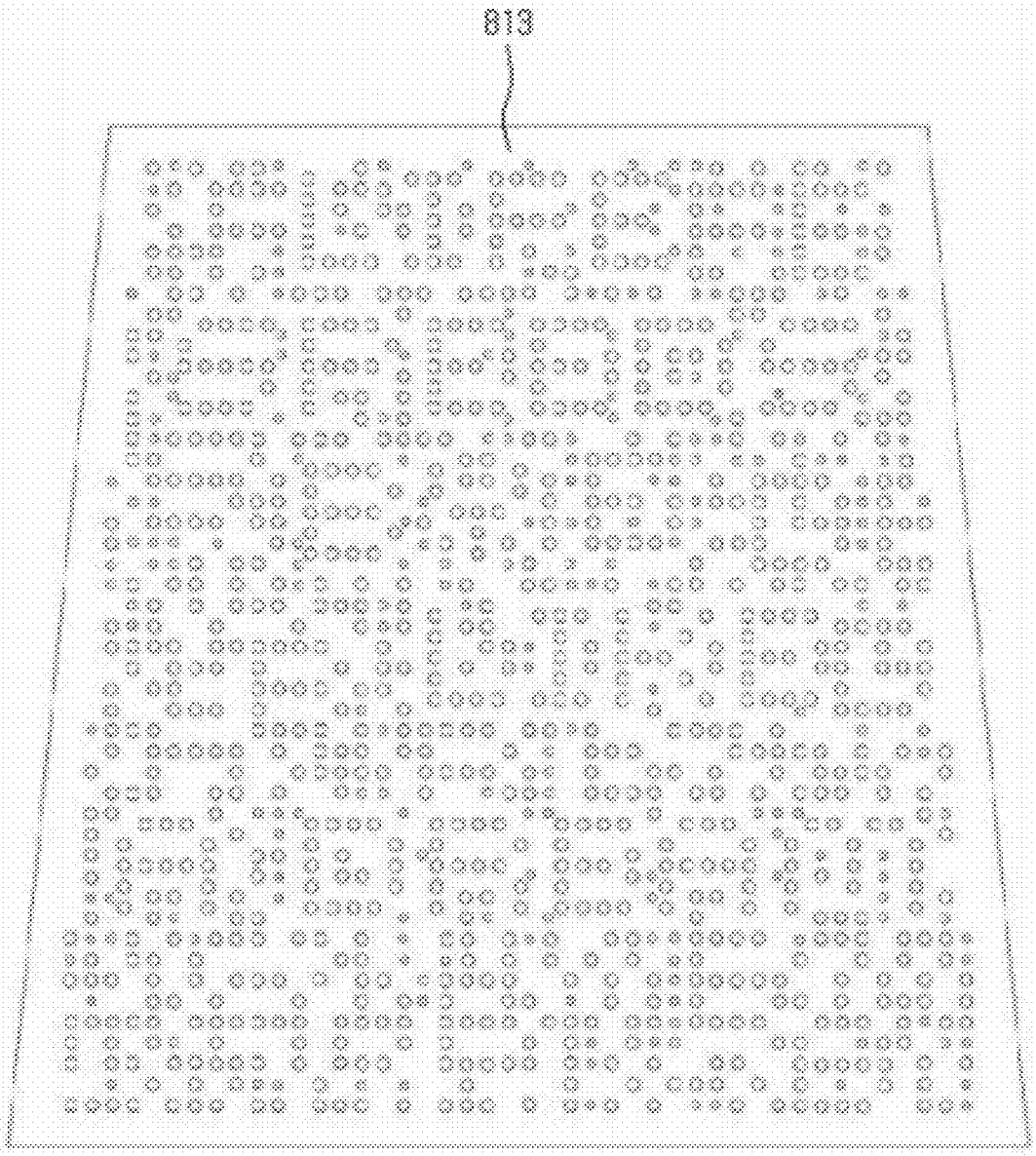
FIG. 13 illustrates a plan view of an inner layer of a message generating panel according to an embodiment of the present invention.
Figure 14:
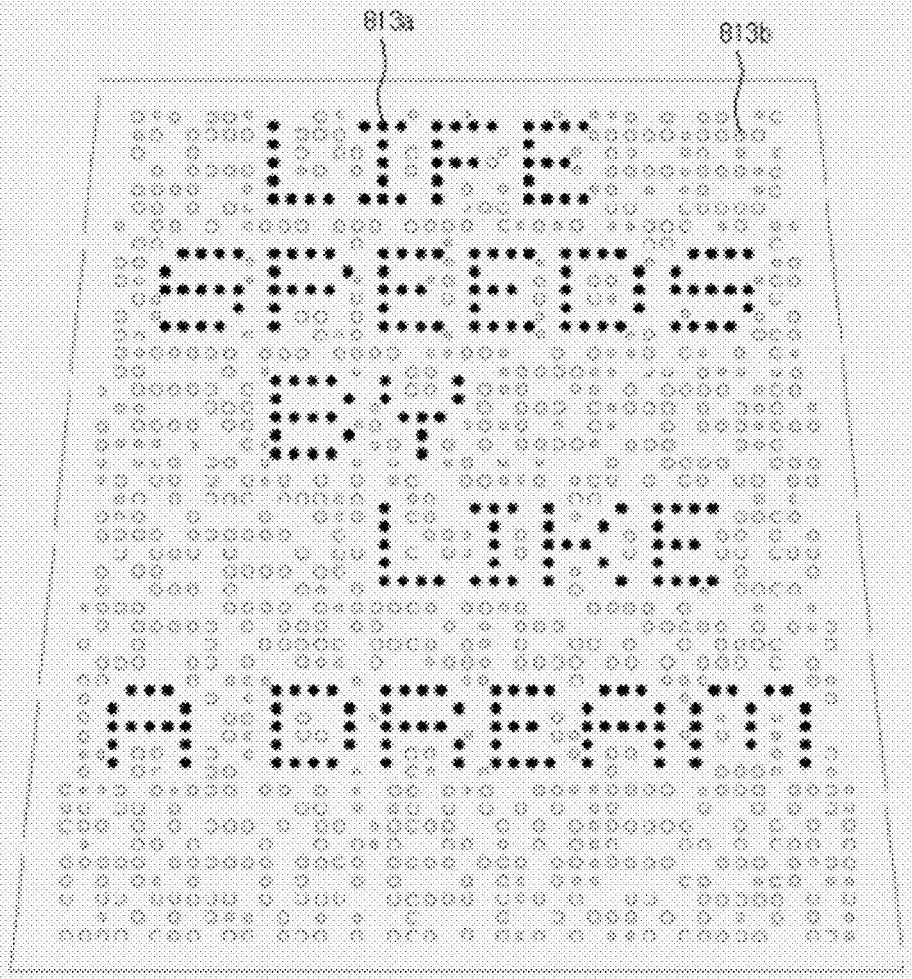
FIG. 14 illustrates a message generating pattern of the inner layer of the message generating panel in FIG. 13.
Figure 15:
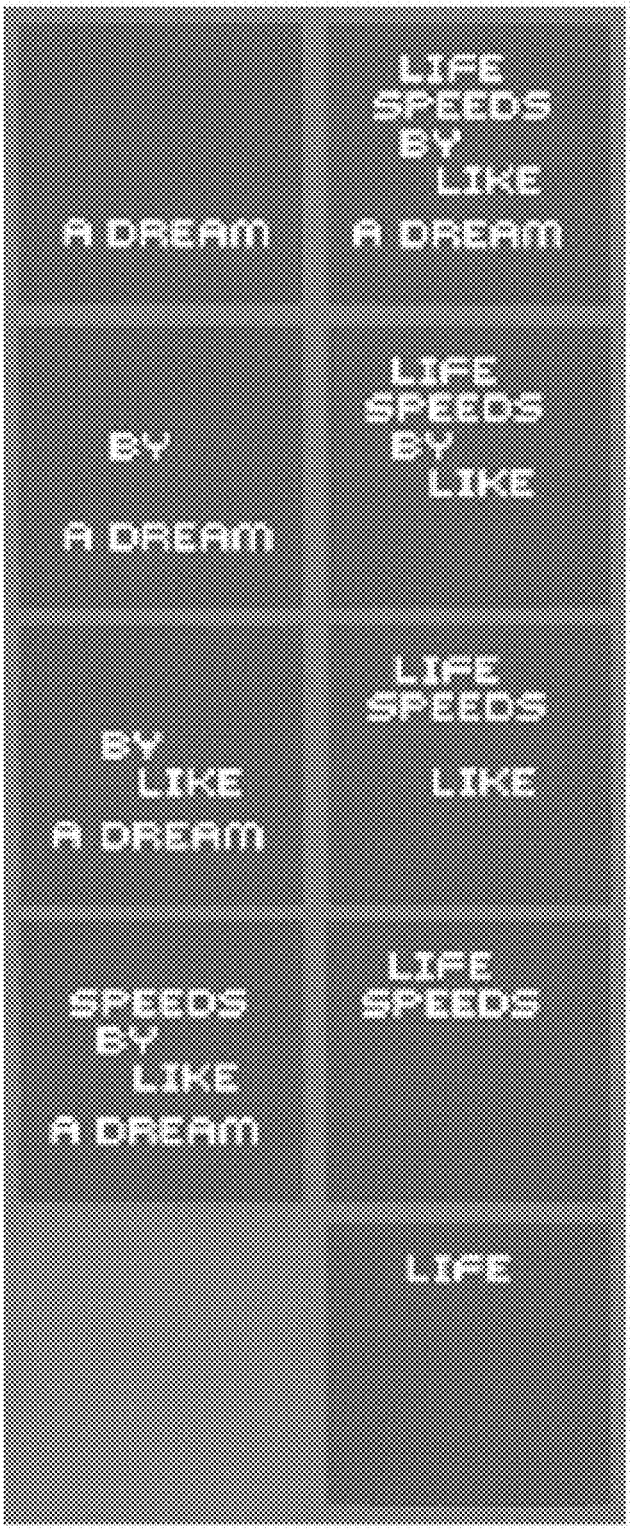
FIG. 15 illustrates messages projected by the message generating panel illustrated in FIG. 13 to FIG. 14.

FIG. 13 illustrates a plan view of an inner layer of a message generating panel according to an embodiment of the present invention. FIG. 14 illustrates a message generating pattern of the inner layer of the message generating panel in FIG. 13. FIG. 15 illustrates messages projected by the message generating panel illustrated in FIG. 13 to FIG. 14.

Referring to FIG. 13 and FIG. 14, an inner layer of a message generating panel can include through holes. It is very difficult to read a text message from the through holes shown in FIG. 13. In FIG. 14, a message pattern (813*a*) composed of through holes to form a message is marked black. The message generating panel can include not only a through hole pattern to generate a message but also a dummy pattern (813*b*) which does not generate a message.

Referring to FIG. 15, change in messages generated by a message generating panel illustrated in FIG. 13 and FIG. 14. As described above referring to FIGS. 1 to 7, duration, brightness and location etc. of a message corresponding to see-through pattern on a layer of the message generating panel can be controlled by configuration of the message generating panel. Text information corresponding to the message pattern (813*a*) of the message generating panel (813) is 'LIFE SPPEDS BY LIKE A DREAM'. Words in the text information can have distinct display duration.

Figure 16:
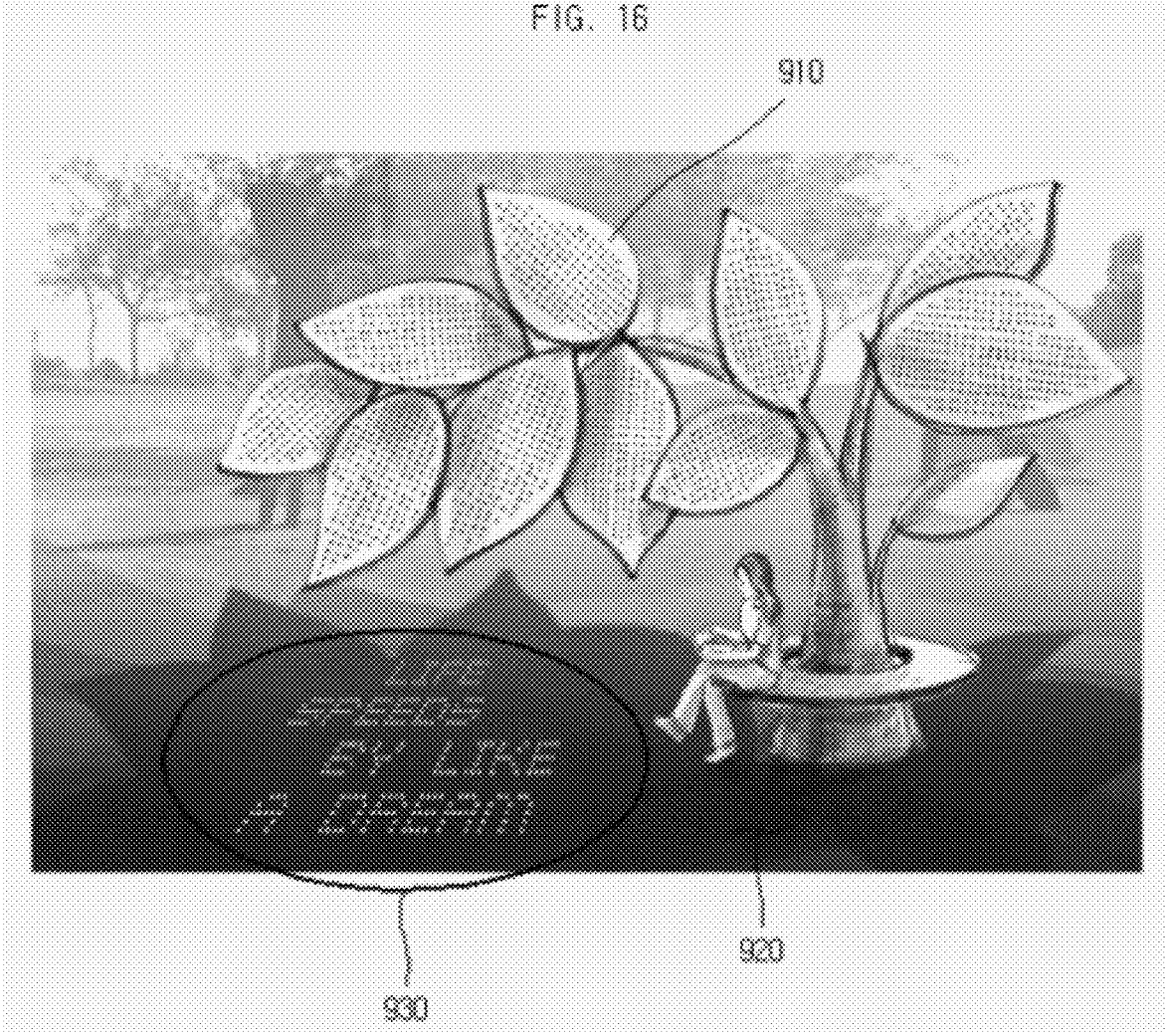
FIG. 16 illustrates a message generating apparatus according to an embodiment of the present invention.

FIG. 16 illustrates a message generating apparatus according to an embodiment of the present invention.

The message generating apparatus in FIG. 16 is a round bench. The message generating apparatus 의message generating panel (910) is like a leaf of tree. The message generating panel provides a shadow (920) around the bench. The sun light passing through the message generating panel (910) can project a shadow message on the ground. In FIG. 16, the message panel represents a message (930)—'LIFE SPPEDS BY LIKE A DREAM'.

As described above, according to an embodiment of the present invention the message generating panel can generate various messages corresponding to incident angles of the lights. Continuous change of incident angle of the sun light can vary location of the message by the sun light continuously. By assigning distinct range of incident angle of the sunlight for each word of the message, words in the message 'LIFE SPPEDS BY LIKE A DREAM' can be displayed, one after the other, according to the incident angle of the sun light.

The message generating panels of the message generating apparatus can be installed in a distinct posture. Effective message generating range of light incident angle can be limited for a single message generating panel. Plural message generating panels can be used for wide range of the light incident angle during day time form east to west. message generating panels in different postures can be used for change in meridian altitude of the sun.

Figure 17:
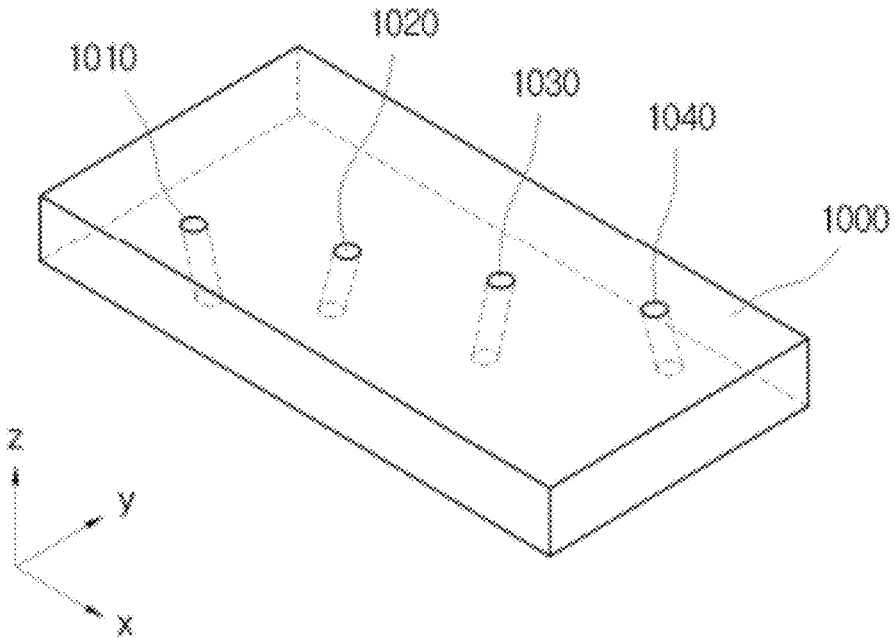
FIG. 17 illustrates a message generating panel including a see-through pattern with a incline-type hole according to an embodiment of the present invention.
Figure 18:
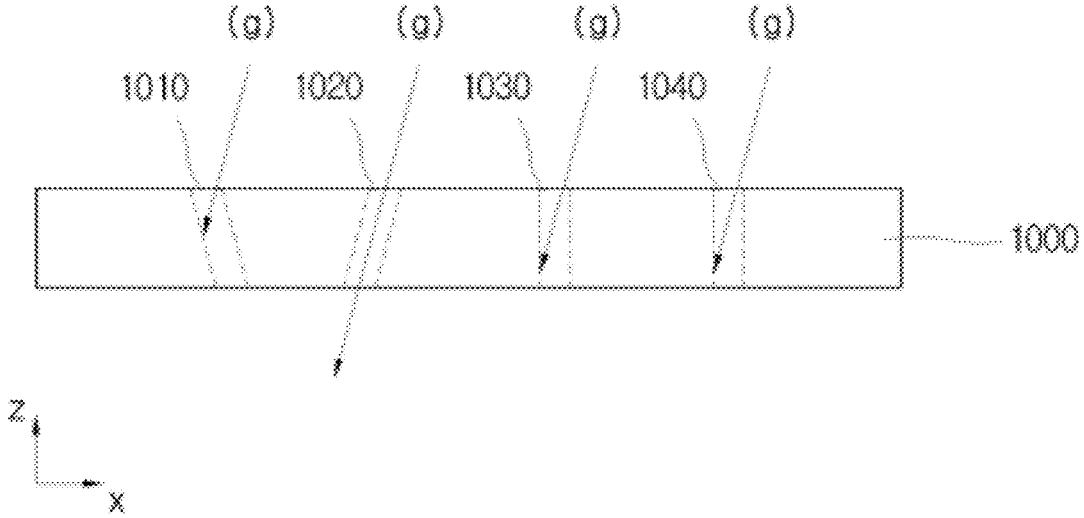
FIG. 18 illustrates a side view of the message generating panel in FIG. 17.
Figure 19:
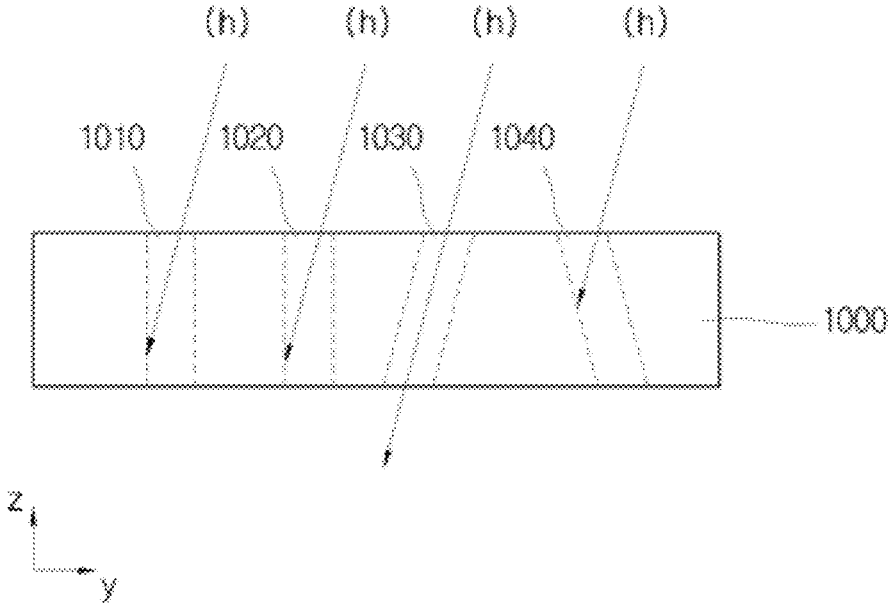
FIG. 19 illustrates another side view of message generating panel in FIG. 17.

FIG. 17 illustrates a message generating panel including a see-through pattern with a incline-type hole according to an embodiment of the present invention. FIG. 18 illustrates a side view of the message generating panel in FIG. 17. FIG. 19 illustrates another side view of message generating panel in FIG. 17.

Referring to FIG. 17, there are shown four through holes in a message generating panel (1000). Central axes of these four through holes have different direction vectors from each other to the surface of the panel (x-y plane).

Referring to FIG. 18, central axis of a first through hole (1010) is on the x-z plane and has a counter-clockwise acute angle from the z axis from the plane. Central axis of a second through hole (1020) is on x-z plane and has a clockwise acute angle from the z axis on the plane. Central axis of a third through hole (1030) is on the y-z plane and has a clockwise acute angle from the z axis on the plane. Central axis of a fourth through hole (1040) is on the y-z plane and has a counter-clockwise acute angle from the z axis on the plane.

In FIG. 18, the (g) direction light can only pass the second through hole (1020) among the 4 through holes. In case a through pattern composed of through holes which have central axes in a same direction as the second through hole (1020) is provided, the (g) direction light can project a message corresponding to the through pattern.

In FIG. 19, the (h) direction light can only pass the third through hole (1030) among the 4 through holes which have distinct central axis directions. In case a through pattern composed of through holes which have central axes in a same direction as the central axis of the third through hole (1030), the message generating panel (1000) can project a message corresponding to the through pattern by the (h) direction light.

The message generating panel (1000) including through holes with distinct central axis directions, can have a selective passing through characteristics according to the light incident direction. By applying inclined through holes to a message generating panel, light path regulation by combination of two layers as in FIG. 1 to FIG. 4 can also be achieved.

By applying a through pattern including inclined through holes, message generation in a circumstance in which set-up angle of a message generating panel is limited.

A dome type message generating apparatus in FIG. 8 to FIG. 10 and a tree type message generating apparatus in FIG. 16 can include plural message generating panels, which have various set-up postures (angle), for a wide range of light incident angle. But, in case a wall of a building is utilized as a message generating panel, the set-up angle may be highly limited. In a such circumstance, a message generating panel with inclined through holes in a layer can be an alternative for an inclined layer. Namely, a panel with incline through holes corresponds to an incline panel including perpendicular through holes.

Figure 20:
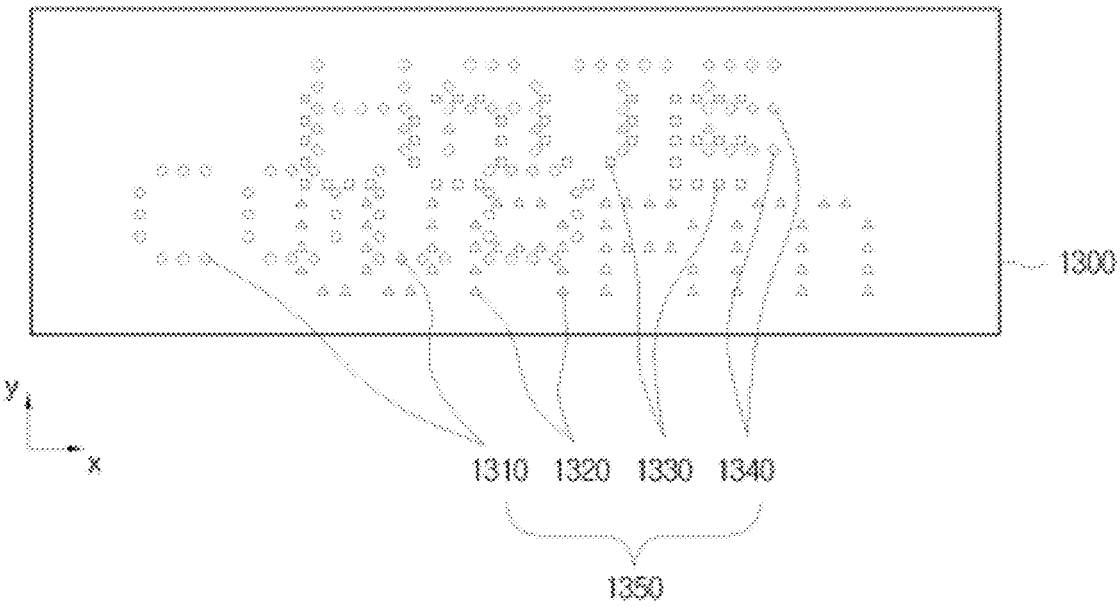
FIG. 20 illustrates a cross-sectional view of message generating panel including a through hole with an inclined central axis according to an embodiment of the present invention.

FIG. 20 illustrates a cross-sectional view of message generating panel including a through hole with an inclined central axis according to an embodiment of the present invention. Through holes which has a same central axis direction have a same cross sectional shape.

A message generating panel (1300) includes 4 message patterns (1350). Each message pattern is composed of through holes having a same central axis direction.

Central axes of through holes of a first message pattern (1310), with a circular cross-sectional shape, have a clockwise acute angle from the z axis on the z-x plane. Central axes of through holes of a second message pattern (1320), having a triangular cross-section, have a counter-clockwise acute angle from the z axis on the z-x plane. Central axes of through holes of a third message pattern (1330), having a rectangular cross-section, have a clockwise acute angle from the z axis on the y-z plane. Central axes of through holes of a fourth message pattern (1340), having a rhombus cross section, have a counter-clockwise acute angle from the z axis on the y-z plane.

Each message pattern can project a message corresponding to the message pattern by transmitting a light, which is in a similar direction to central axes of the through holes of the message pattern. The passing through characteristics by a inclined through hole can be understood referring to FIG. 17 to FIG. 19.

Figure 21:
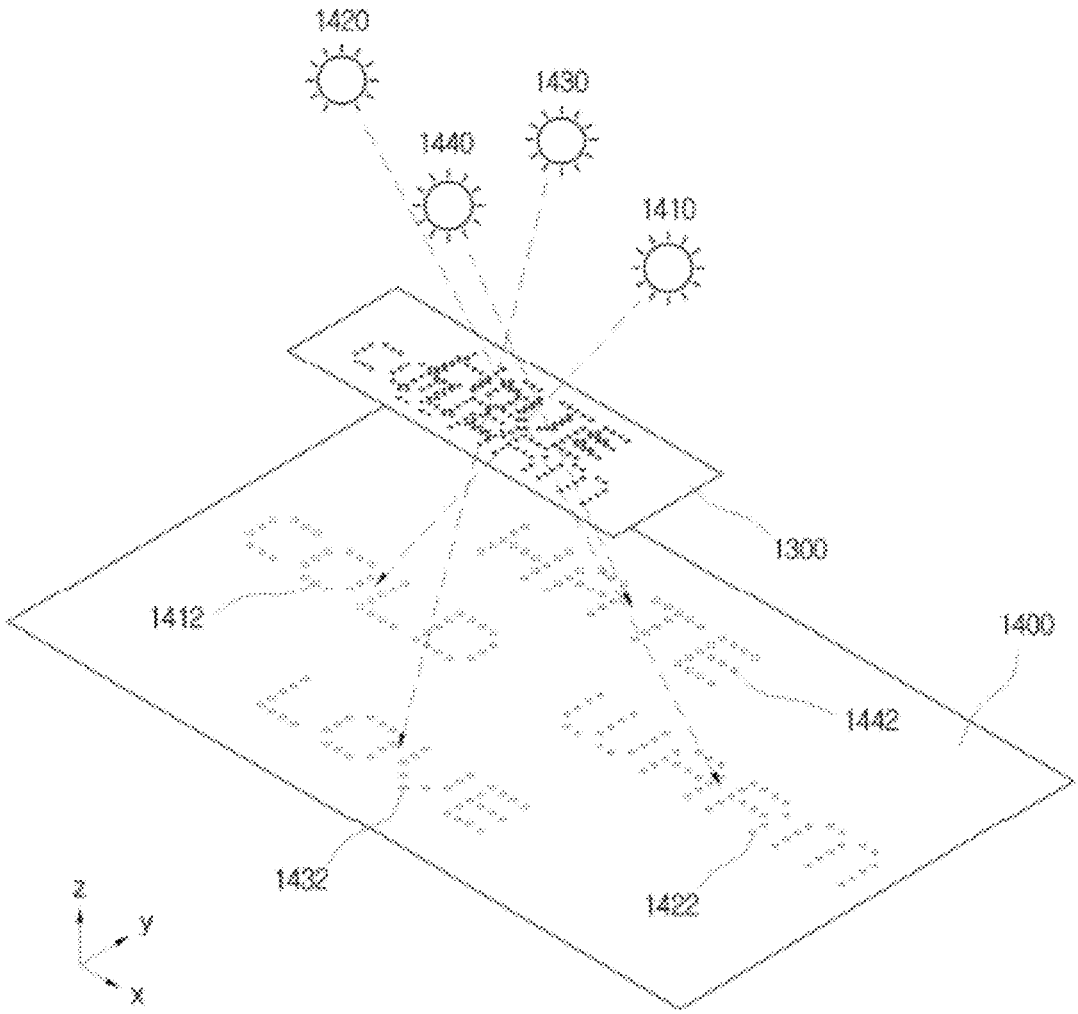
FIG. 21 illustrates messages generated by the message generating panel in FIG. 20 in different illumination conditions.

FIG. 21 illustrates messages generated by the message generating panel in FIG. 20 in different illumination conditions.

Referring to FIG. 21, in case a light source is in a first position (1410), a light from the light source can only transmit through the first message pattern (1310) of the message generating panel (1300) and may not transmit through other message patterns (1320, 1330, 1340). The light passed through the first message pattern (1310) represents a first message (1412) on a screen (1400). The first message (1412) can be a represented in a circular (elliptical) shape according to the cross section shape of the first message pattern (1310).

In case the light source is at a second position (1420), a second message (1422) can be represented by a light passed through the second message pattern (1320) of the message generating panel (1300). In case the light source is at a third position (1430), a third message (1432) can be projected on the screen (1400) by a light passed through the third message pattern (1330) of the message generating panel (1300). When the light source is at a fourth position (1440), a fourth message (1442) can be projected to the screen (1400) by a light passed through the fourth message pattern (1340). The projected messages can be displayed in same shapes as the cross sectional shape of the corresponding message patterns.

As described referring to FIG. 20 and FIG. 21, by utilizing an through hole having an inclined central axis from a normal vector of a surface of a message generating panel, distinct projection messages can be generated according to positions of the light source. It is described above that, applying a message generating panel with a inclined through hole and inclining a message generating panel itself can be result in s same consequence.

By applying a single layer with inclined through hole, the effect of plural layer message generating panel as in FIG. 1 to FIG. 4 can be achieved. Also, variety of message generation can be realized by combining a layer with a inclined through hole and other layer.

Figure 22:
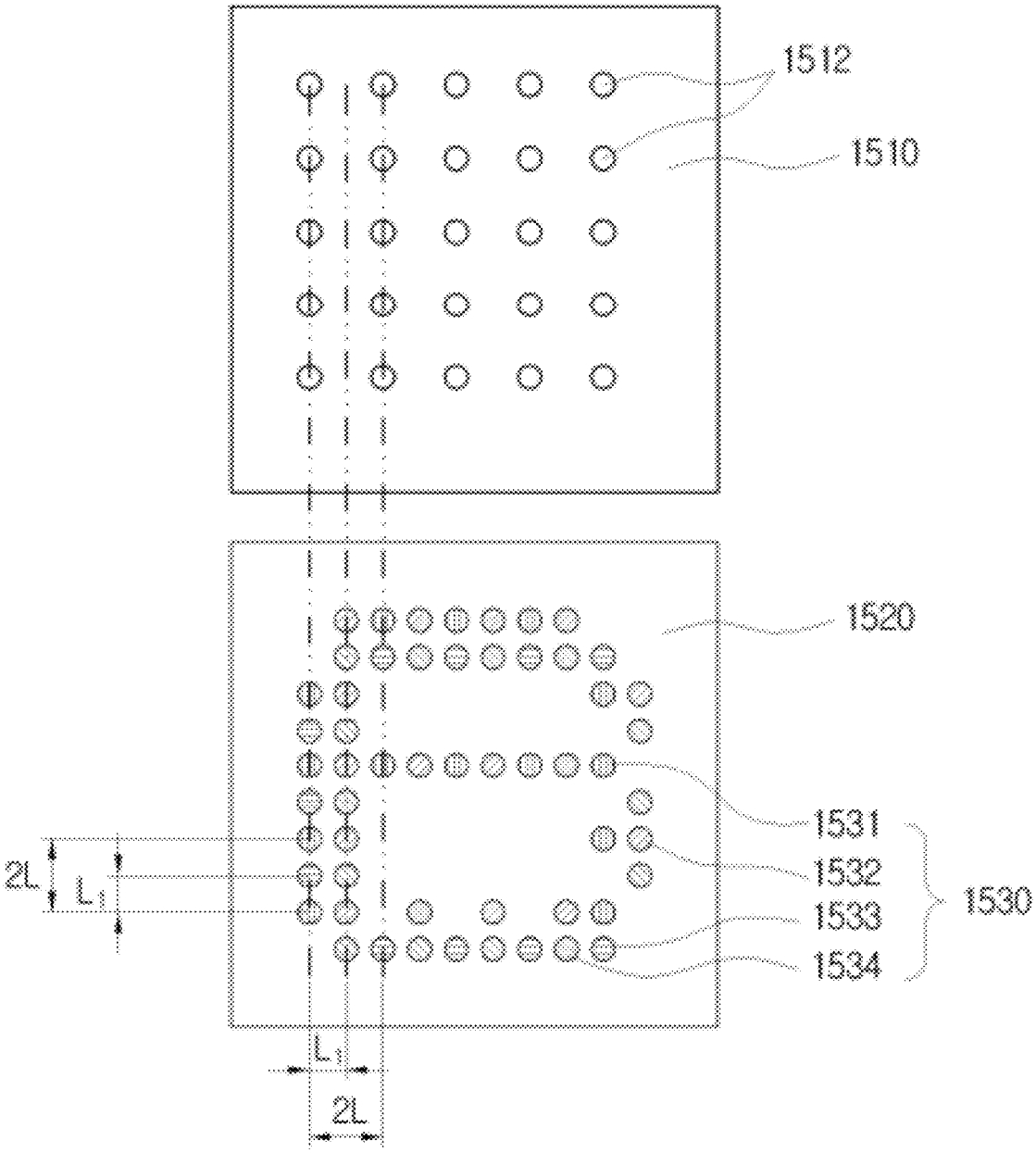
FIG. 22 illustrates a cover layer and a base layer of a message generating panel according to an embodiment of the present invention.
Figure 23:
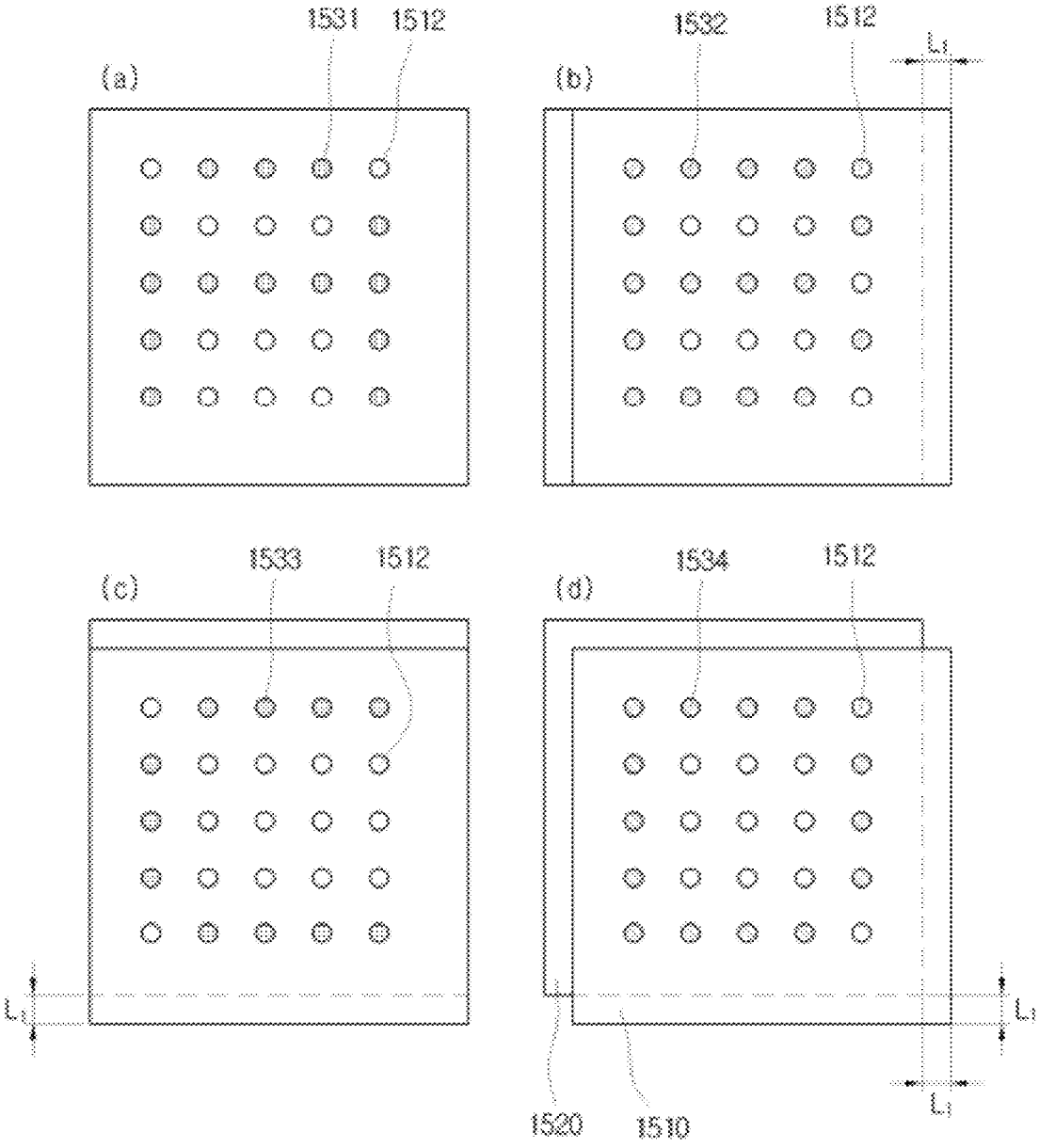
FIG. 23 illustrates 4 overlapping modes of the cover layer and the base layer in FIG. 22.

FIG. 22 illustrates a cover layer and a base layer of a message generating panel according to an embodiment of the present invention. FIG. 23 illustrates 4 overlapping modes of the cover layer and the base layer in FIG. 22.

A cover layer (1510) of a message generating panel can include a through pattern (1512). The through pattern (1512) includes 25 through holes on the cover layer (1510). The through pattern (1512) forms a grid pattern.

A base layer (1520) of the message generating panel includes 4 message patterns (1530). The message pattern (1530) is composed of circular marks which are arranged in a square grid. The circular marks of a message pattern corresponds to a grid of the through pattern (1512) of the cover layer (1510). Interval between two neighbor circular marks in a message pattern (2L) is same as the interval between two neighbor through holes of the through pattern (1512).

The first message pattern (1531), the second message pattern (1532), the third message pattern (1533) and the fourth message pattern (1534) correspond to alphabet letter A, B, C and D respectively. In case the 4 patterns (1530) is printed on the base layer (1520), a message in each of the patterns (1530) cannot be notified easily. It is difficult to distinguish a single message pattern from 4 fourth message patterns.

By overlapping the cover layer (1510) on the base layer (1520) including plural message patterns, each message of a message pattern (1531, 1532, 1533, 1534) can be read separately. Overlapping modes for the cover layer (1510) and the base layer (1520) will be described below referring to FIG. 23.

Referring to the overlapping mode (a) in FIG. 23, the through pattern (1512) of the cover layer (1510) is overlapped on the first message pattern (1531) of the base layer (1520). The first message pattern (1531) represents the message A. other marks of the other message patterns are not exposed.

In case the cover layer (1510) is moved right by half of the interval of hrough pattern grid form the overlapping mode (a), the through pattern (1512) will be overlapped to the second message pattern (1532). In this overlapping mode (b), the message generating panel represents the message B by the overlapped cover layer (1510) and base layer (1520).

In case the cover layer (1510) is moved downward from the overlapping mode (a), the through pattern (1512) is overlapped with the third message pattern (1533). In this overlapping mode (c) the message generating panel represents the message C.

In case cover layer (1510) is moved right from the overlapping mode (c) the through pattern (1512) is overlapped with the fourth message pattern (1534). In this overlapping mode (d), the message generating panel represents the message D.

In this embodiment, the message patterns (1530) of the base layer (1520) are composed of circular marks corresponding to the through holes of the through pattern (1512) of the cover layer (1510). The marks of the message pattern do not need to be a same size or same shape as the through holes. Any marks which can represent a message overlapped with the through pattern (1512) of the cover layer can be used for a message pattern of the base layer.

Figure 24:
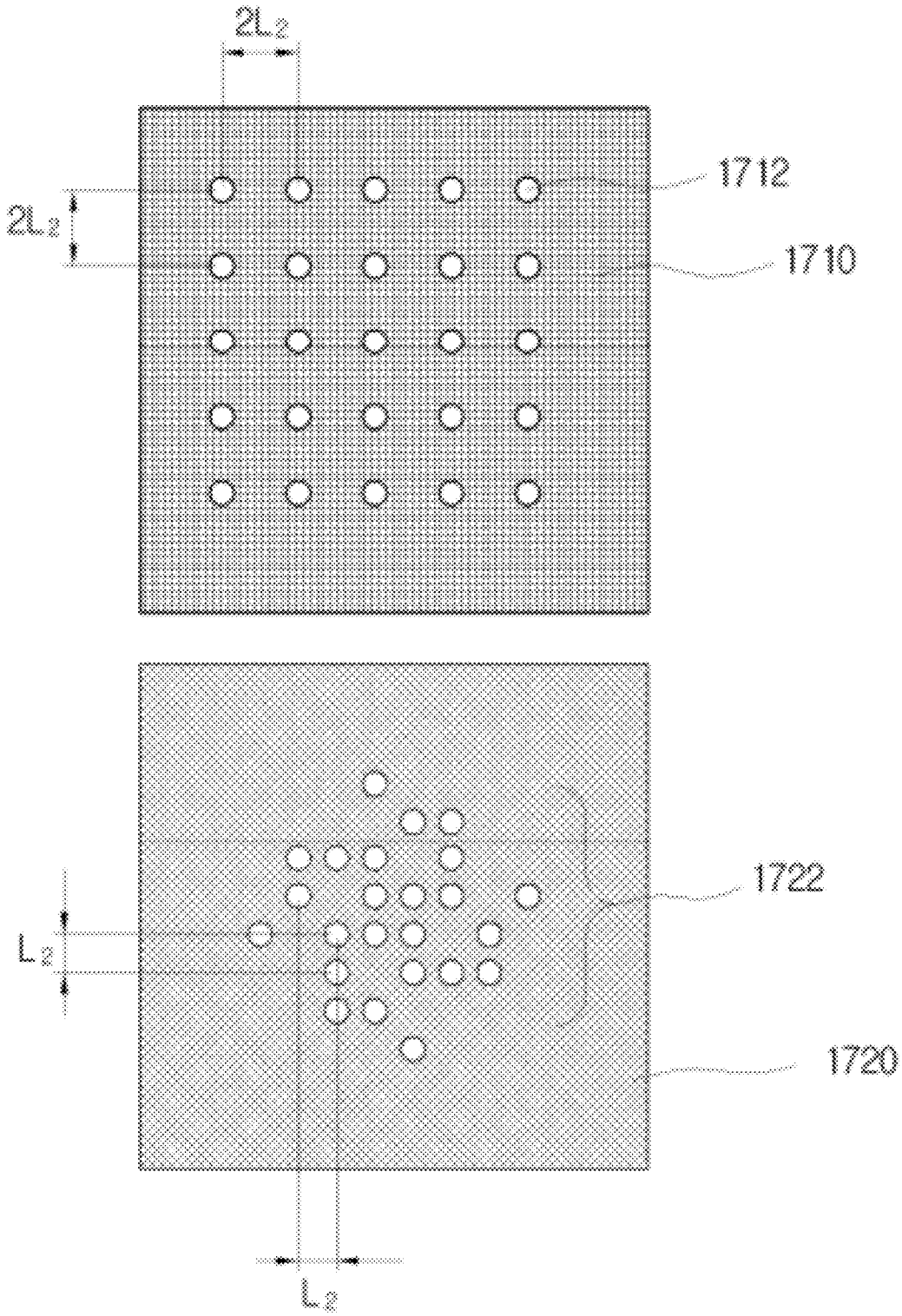
FIG. 24 illustrates a cover layer and a base layer of a message generating panel according to an embodiment of the present invention.
Figure 25:
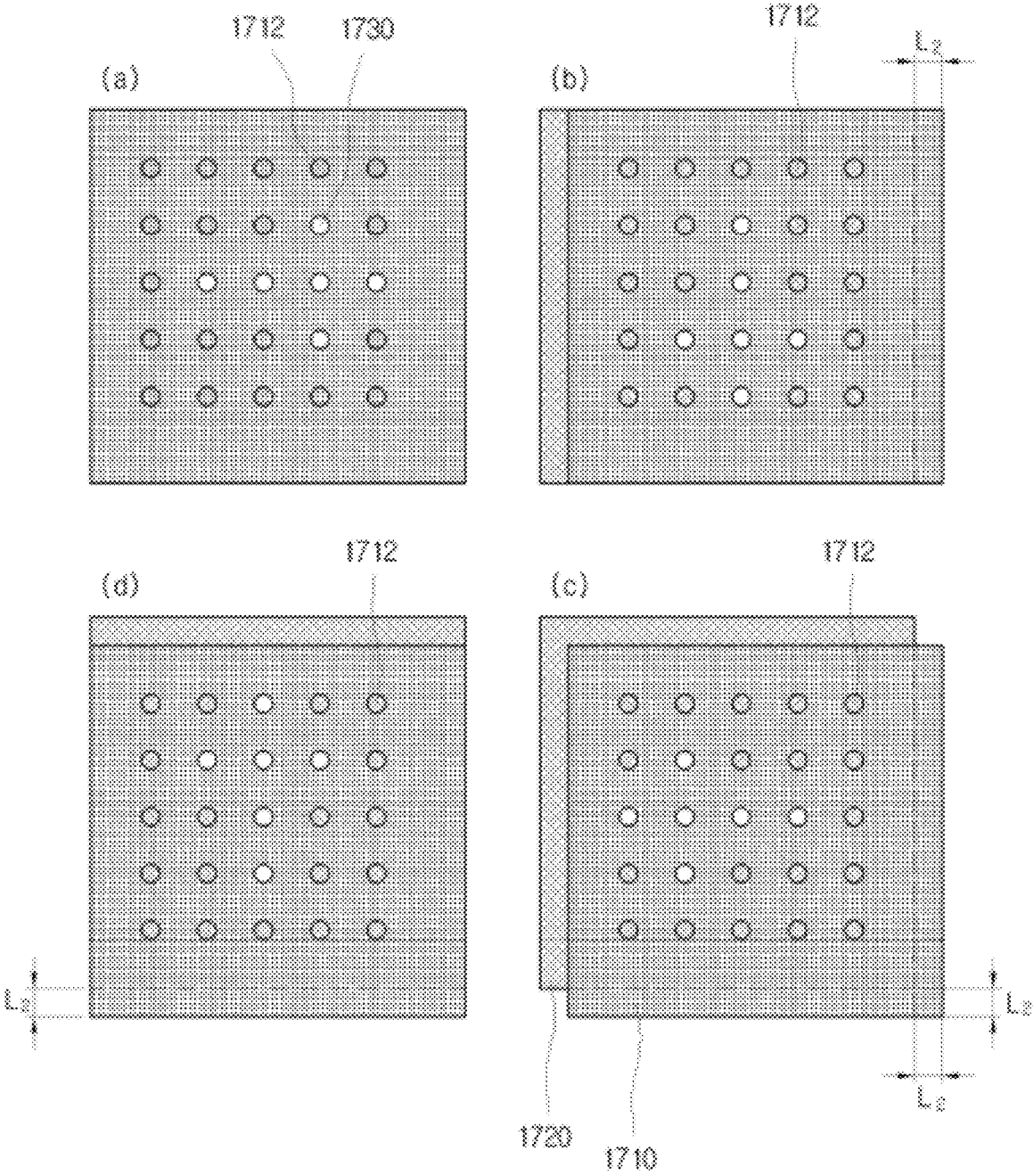
FIG. 25 illustrates 4 overlapping modes of the cover layer and the base layer in FIG. 24.

FIG. 24 illustrates a cover layer and a base layer of a message generating panel according to an embodiment of the present invention. FIG. 25 illustrates 4 overlapping modes of the cover layer and the base layer in FIG. 24.

A cover layer (1710) includes 25 through holes. These through holes form a through pattern (1712) in a grid shape. A base layer (1720) includes a message pattern (1722) in a spiral shape. The spiral message pattern (1722) is a group of through holes which corresponding to several messages.

Each message of the message pattern (1722) can be represented by overlapping the cover layer (1710) with the base layer (1720). The represented messages by the overlapping of the cover layer (1710) and the base layer (1720) are illustrated in FIG. 25.

Referring to the overlapping mode (a) in FIG. 25, the panels are overlapped entirely. In this case, overlapped part of a through pattern (1712) and a message pattern (1722) does not blocked by the panels. A message can be represented by this unblocked region (1730) itself. A message can be represented by background through the unblocked region (1730). A message can also be projected through the unblocked region (1730). In the overlapping mode (a) the message given by the message generating panel is a right arrow.

In case the cover layer (1710) is shifted right by L2, following the given message in the overlapping mode (a), the message generating panel is converted to the overlapping mode (b). In the overlapping mode (b), a message given by the message generating panel is a downward arrow.

In case the cover layer (1710) is shifted downward by L2, following the given message in the overlapping mode (b), the message generating panel is changed into the overlapping mode (c). In the overlapping mode (c), a message given by the message generating panel is a left arrow.

In case the cover layer (1710) is shifted left by L2, following the given message in the overlapping mode (c), the message generating panel reaches the overlapping mode (d). In the overlapping mode (d), a message given by the message generating panel is an upward arrow. When the cover layer (1710) is moved upward following this message, the message generating panel returns to the overlapping mode (a).

As described above, for a message generating panel representing plural messages by overlapping two layers, messages by the message generating panel can be explored easily by showing the layer shift direction.

Figure 26:
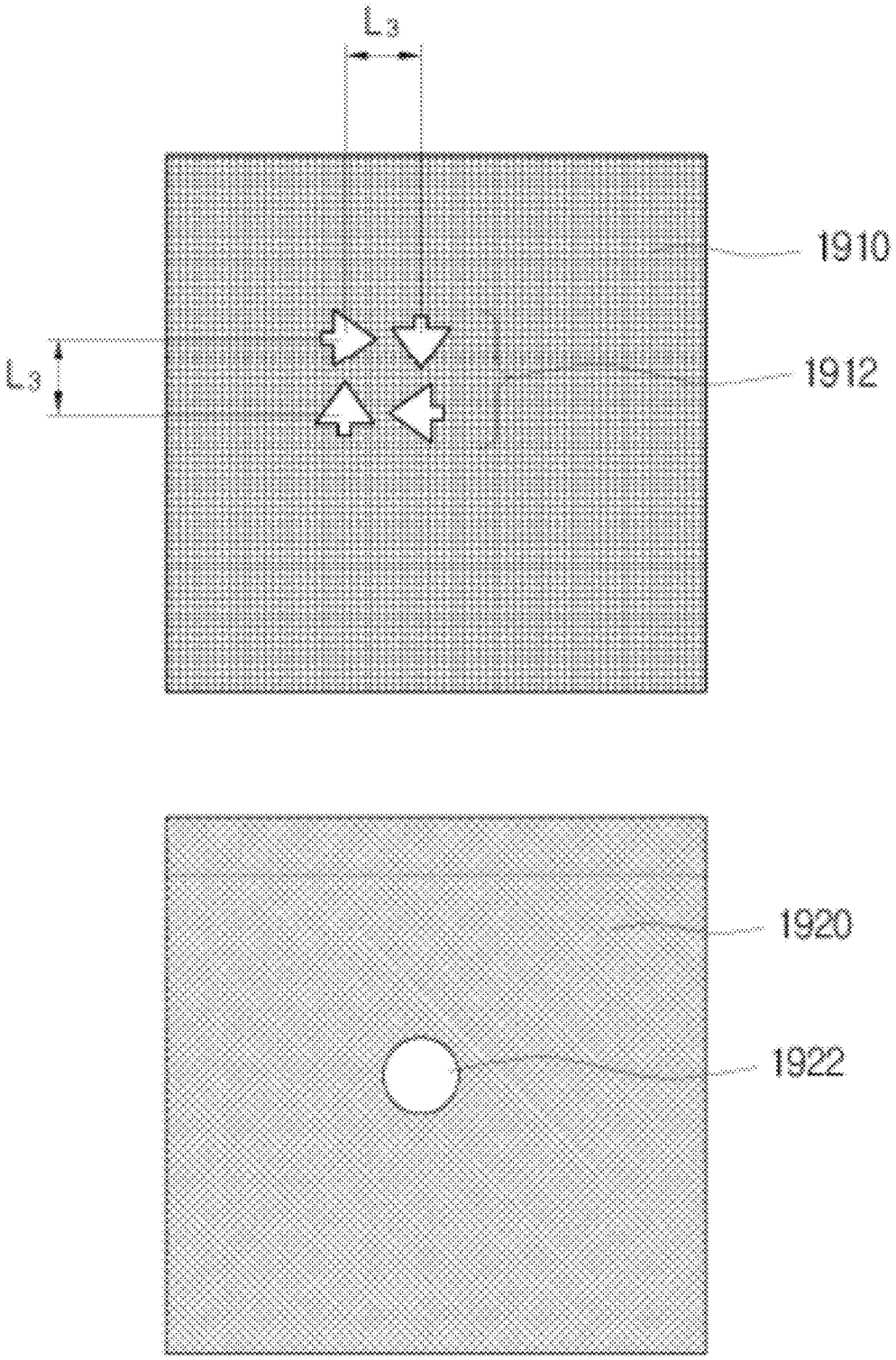
FIG. 26 illustrates a cover layer and a base layer of a message generating panel according to an embodiment of the present invention.
Figure 27:
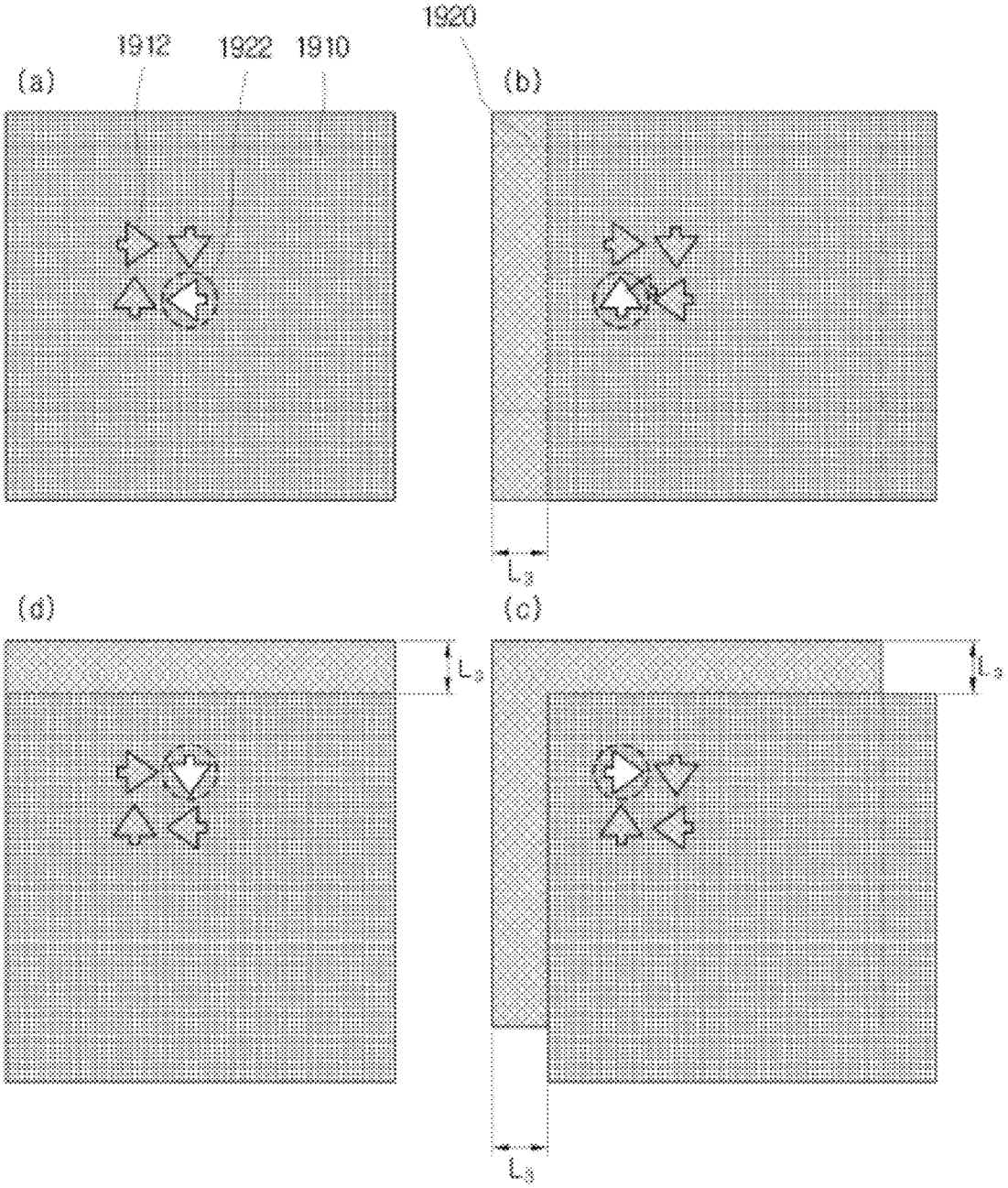
FIG. 27 illustrates 4 overlapping modes of the cover layer and the base layer in FIG. 26.

FIG. 26 illustrates a cover layer and a base layer of a message generating panel according to an embodiment of the present invention. FIG. 27 illustrates 4 overlapping modes of the cover layer and the base layer in FIG. 26.

In this embodiment, a message generating panel includes a cover layer (1910) and a base layer (1920). The cover layer (1910) and the base layer (1920) include an arrow pattern (1912) and circular pattern (1922) respectively. In the overlapping mode (a) of FIG. 27 the two layers are overlapped entirely. In the overlapping mode (a), a message given by the message generating panel is a left arrow.

When the base layer (1920) is shifted by L3 following the given message in the overlapping mode (a), the message generating panel reaches the overlapping mode (b). In this case, a message given by the overlapped two layers is an upward arrow. In case the base layer (1920) is shifted upward by L3, following the given message, the message generating panel reaches the overlapping mode (c).

In the overlapping mode (c), a given message is a right arrow. When the base layer (1920) is shifted right by L3, following the given message, the message generating panel can be converted to the overlapping mode (d). In the overlapping mode (d), a shift of the base layer following the message (downward arrow) can move the message generating panel to the overlapping mode (a) again.

In this embodiment, a message representing patterns in the overlapping modes of the message generating panel is formed on the cover layer (1910). Also, the represented message indicates the moving direction of base layer (1920) toward the next overlapping mode.

The overlapping modes in FIG. 27 illustrate message generating panel shown from the cover layer side. Meanwhile, shown from the base layer side, the generated message and layer movement direction is similar to the description about FIG. 25. In this case, the represented message indicates movement direction of a viewer side layer of the message generating panel.

Figure 28:
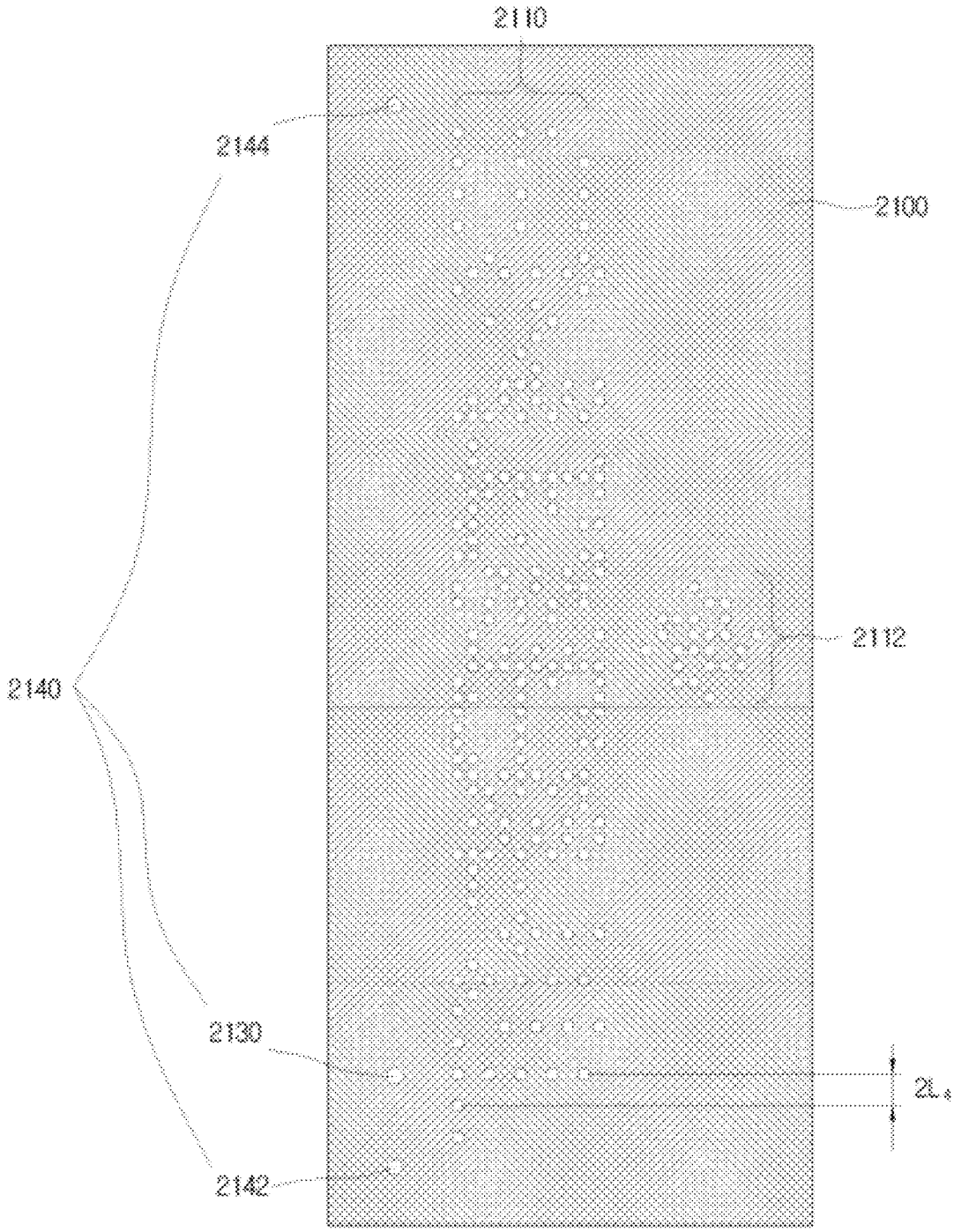
FIG. 28 illustrates a base layer of a message generating panel according to an embodiment of the present invention.
Figure 29:
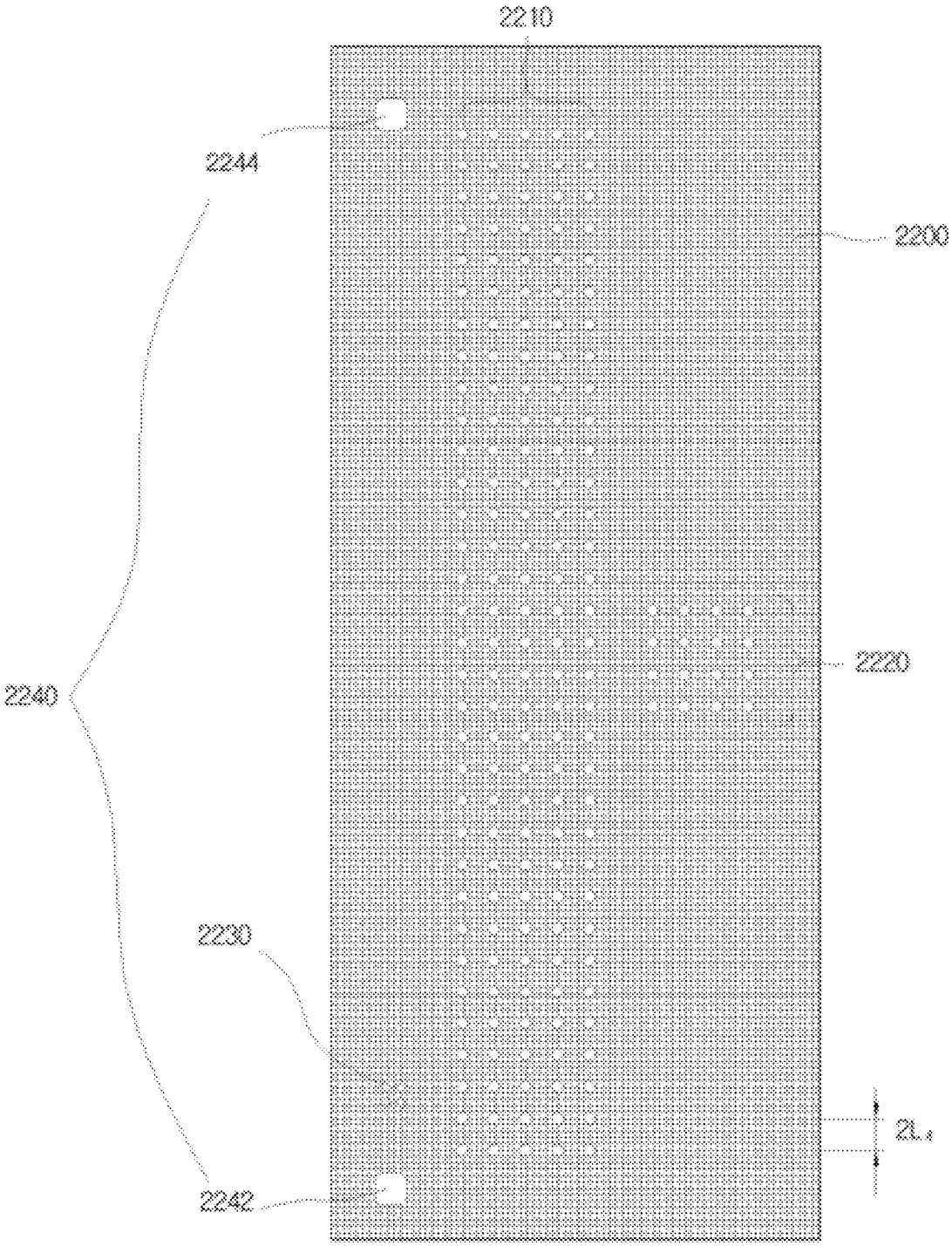
FIG. 29 illustrates a cover layer according to an embodiment of the present invention.

FIG. 28 illustrates a base layer of a message generating panel according to an embodiment of the present invention. FIG. 29 illustrates a cover layer according to an embodiment of the present invention.

A base layer (2100) in FIG. 28 includes a first message pattern (2110) and a second message pattern (2112) composed of through holes. The first message pattern (2110) is a group of through holes containing several words. The second message pattern (2112) is a pattern, containing 4 directional arrows, as the message pattern (1722) in FIG. 24. The base layer (2100) includes a circular pattern (2130) similar to the described circular pattern (1922) in FIG. 26.

The base layer (2100) includes a first guide patterns (2140) for coupling with the cover layer (2200). A left guide pattern (2142) and a right guide pattern 2144 of the base layer (2100) can indicate relative arrangement change to generate messages by overlapping with a left guide pattern (2242) and a right guide pattern (2244) of the cover layer (2200) respectively.

The cover layer (2200) in FIG. 29 can also include several patterns composed of through hole(s). A first grid pattern (2210) can represent a message overlapped with a region occupied by the first message pattern (2110) of the base layer (2100). A second grid pattern (2220) can represent a arrow type message, being overlapped a region occupied by the second message pattern 2112 of the base layer (2100). An arrow pattern (2230) on the cover layer (2200) is similar to the arrow pattern (1912) in FIG. 26. The arrow pattern (2230) overlapped with a circular pattern (2130) of the base layer can generate a direction message as described in FIG. 27. The cover layer (2200) also includes a second guide pattern (2240).

Messages given by overlapping the cover layer (2200) and the base layer (2100) will be described referring to FIG. 30 to FIG. 33.

FIG. 30 to FIG. 33 illustrate 4 overlapping modes of the message generating panel in FIG. 28 and FIG. 29 according to an embodiment of the present invention.

Figure 30:
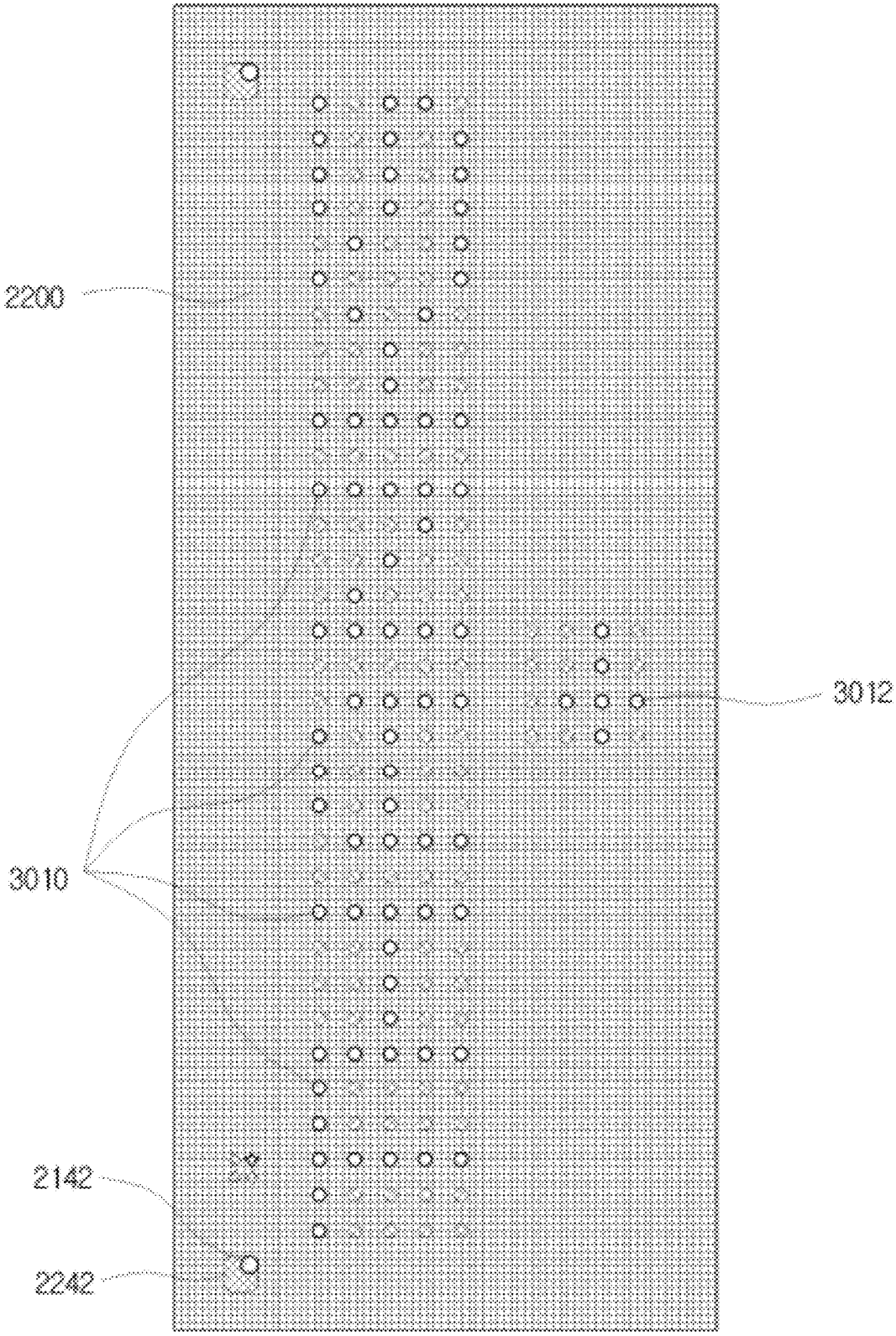
FIG. 30 to FIG. 33 illustrate 4 overlapping modes of the message generating panel in FIG. 28 and FIG. 29 according to an embodiment of the present invention.

In a first overlapping mode in FIG. 30, the cover layer (2200) and the base layer (2100) are overlapped entirely. The first guide patterns (2140) of the base layer (2100) are located in low-right corner of the second guide pattern (2240) of the cover layer (2200). The four corners of the second guide pattern (2240) correspond to locations of the first guide pattern in 4 overlapping mode in FIG. 30 to FIG. 33.

In the first overlapping mode of FIG. 30, through holes corresponding to 'THANKS' among several sub message patterns of the first message pattern (2110) are overlapped with the first grid pattern (2210) of the cover layer (2200). Thus, through holes (3010) not blocked by the panel of the cover layer (2200) can represent 'THANKS'. The un-blocked part of the second message pattern 2112 by the cover layer (2200) represents a left arrow. The arrow pattern (2230) of the cover layer (2200), being overlapped with the circular pattern (2130) of the base layer (2100) can represent a left arrow. The second overlapping mode in FIG. 31 can be reached by shifting the base layer (2100) by L4, following the represented left arrow message (3012) in the first overlapping mode in FIG. 30.

Figure 31:
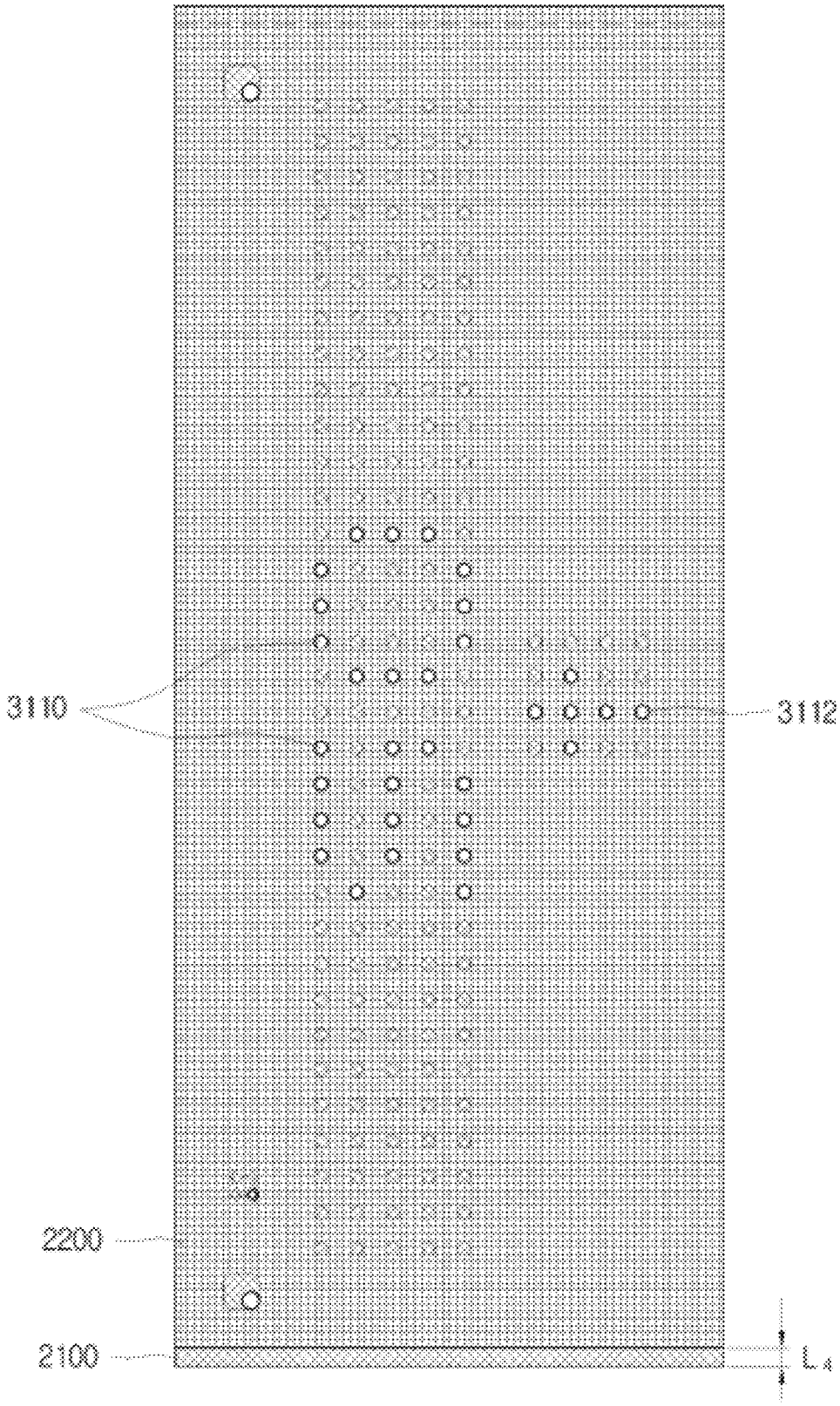

In the second overlapping mode in FIG. 31, the first guide patterns (2140) fits to low-left corner of the second guide patterns (2240). In the second overlapping mode, unblocked part (3110) of the first message pattern (2110) which does not be blocked by the cover layer (2200) can represent a message 'SO'. In the second overlapping mode, the unblocked second message pattern 2112 shows a upward arrow. In the second overlapping mode in FIG. 31, the base layer (2100) can be shifted following the upward arrow message (3112) to reach the third overlapping mode in FIG. 33.

Figure 32:
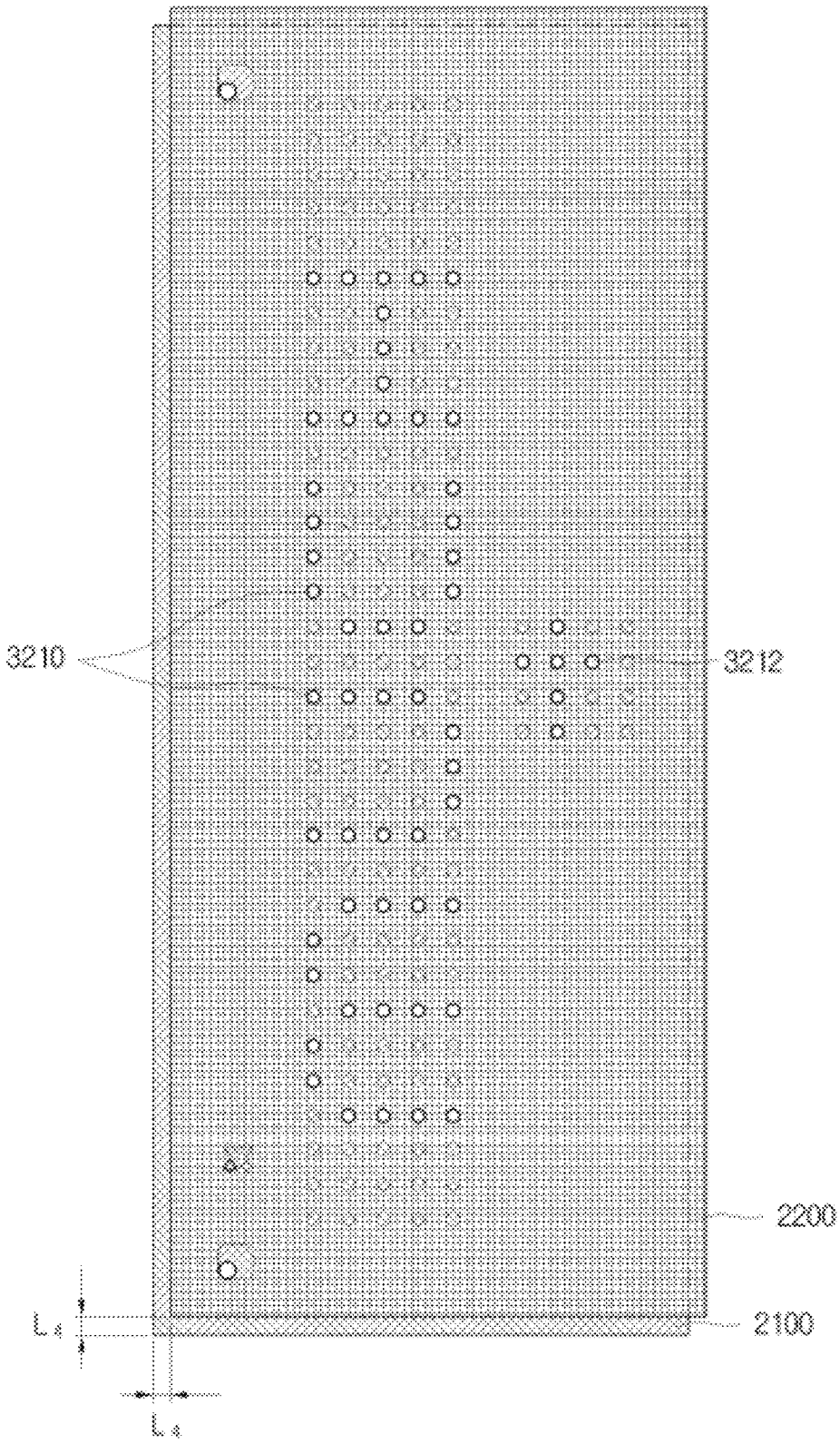

In the third overlapping mode in FIG. 32, the first guide patterns (2140) fits to up-left corner of the second guide patterns (2240). In the third overlapping mode, the un-blocked part (3210) of the first message pattern (2110) shows the message 'MUCH'. Un-blocked part (3212) of the second message pattern (2112) indicates a right arrow. The fourth overlapping mode in FIG. 33 can be reached by shifting the base layer (2100) following the right arrow message (3212) in the third overlapping mode in FIG. 32.

Figure 33:
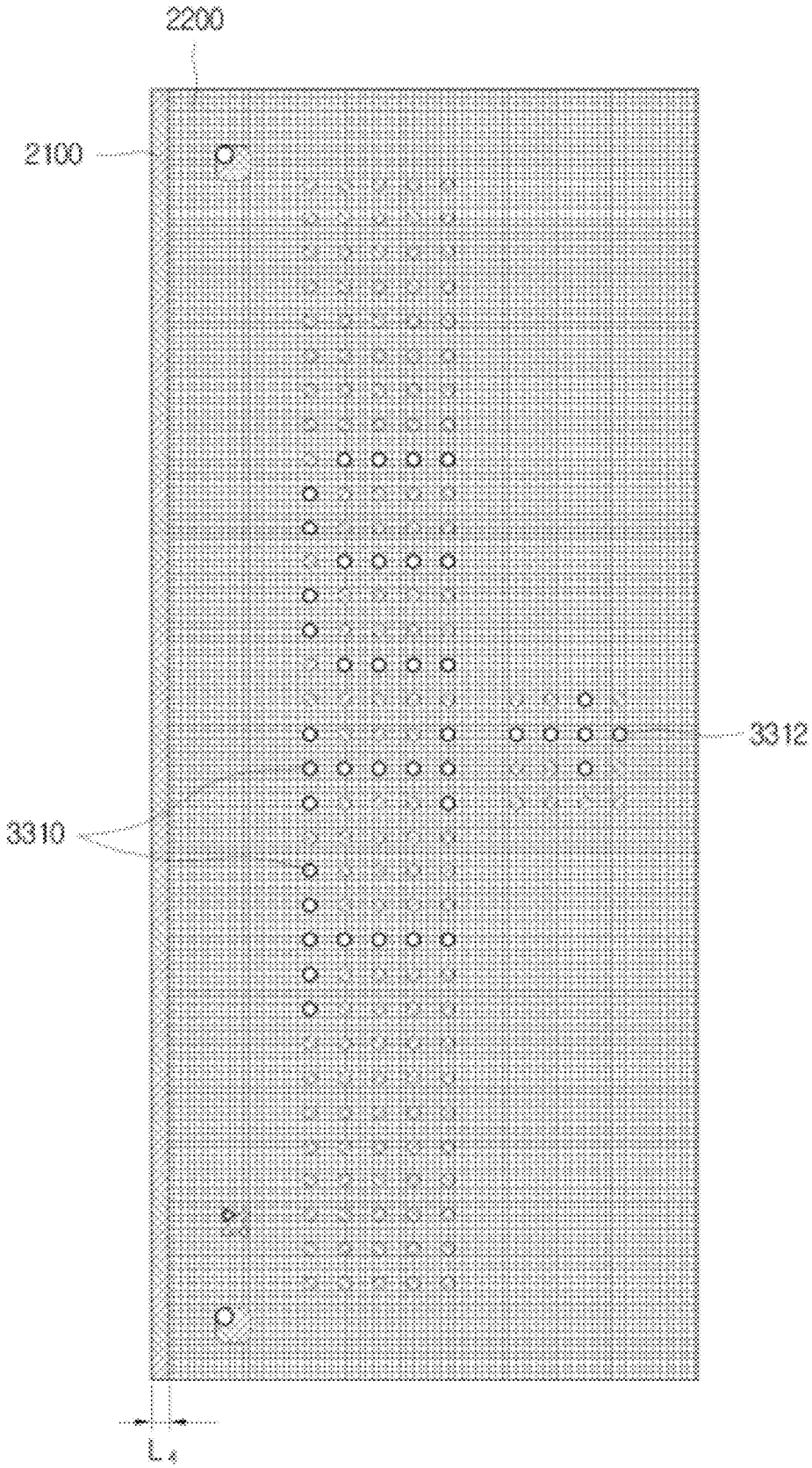

In the fourth overlapping mode in FIG. 33, the first guide patterns (2140) fits up-right corner of the second guide patterns (2240). The through holes (3310) of the first message pattern (2110) which is not blocked by the cover layer (2200) In the fourth overlapping mode represent the message 'TIM'. Un-blocked part (3312) of the second message pattern (2112) shows a downward arrow. When the base layer (2100) is moved following the represented downward arrow, the message generating panel returns to the first overlapping mode.

As described above, text message given in the 4 overlapping modes is 'THANKS SO MUCH TIM'. A person with a single base layer (2100) can hardly read the text message. By overlapping the cover layer (2200) with the base layer (2100), hidden messages can be read. Also, message reading is guided by representing arrow message which indicates layer movement direction for conversion from one overlapping mode to another overlapping mode.

Figure 34:
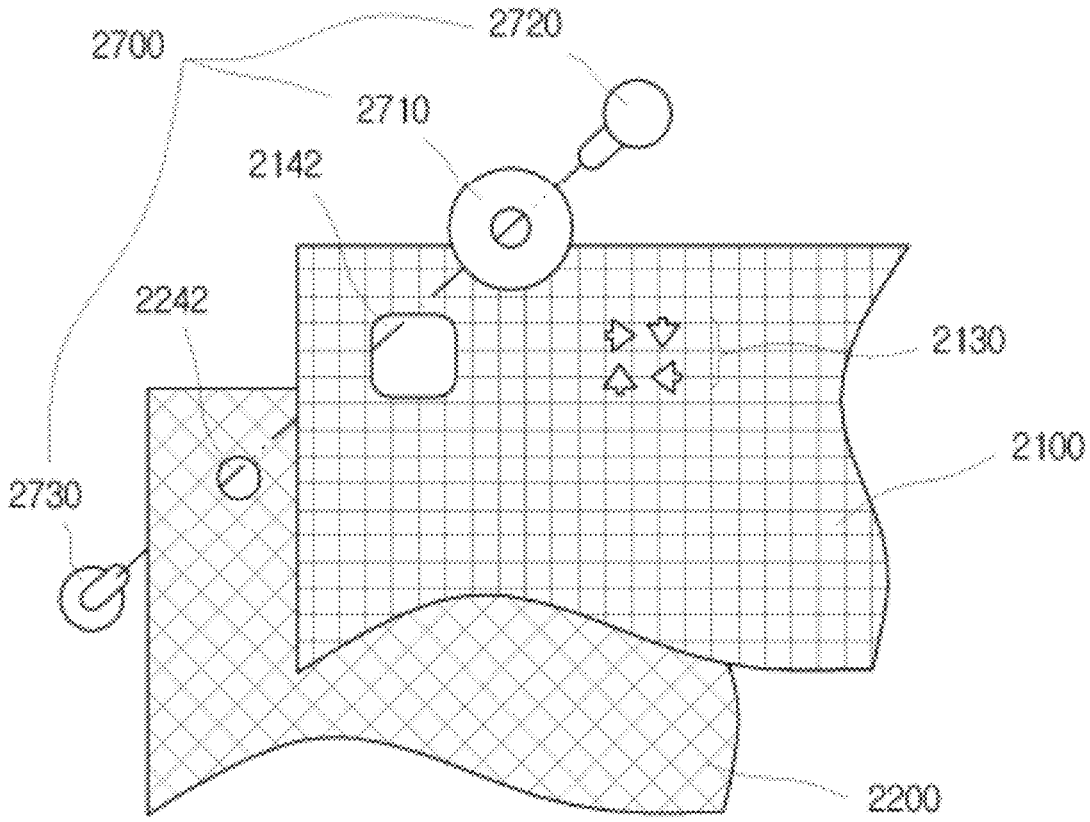
FIG. 34 illustrates a coupling structure of a cover layer and a base layer according to an embodiment of the present invention.

FIG. 34 illustrates a coupling structure of a cover layer and a base layer according to an embodiment of the present invention. Two layers (2100, 2200) of the message generating panel according to this embodiment can be coupled through the guide patterns (2142, 2242). A layer coupling mean (2700) can include two rivets (2710. 2720) and a brush (2710). Diameter of a joining axle (part) of the two rivets corresponds to a diameter of the guide pattern (2142) of the base panel (layer). Messages can be represented effectively by limiting relative arrangement of the layers with the coupling structure.

The message generating panel in this embodiment can be a card pair containing a hidden message. A single card corresponds to the base layer in FIG. 28 or the cover layer in FIG. 29 cannot teach a hidden message. These two cards can represent a hidden message by being overlapped properly considering the guide patterns.

Each layer of the message generating panels can be formed based on a opaque base substance. But, the layer of the message generating panel does not to be based on an opaque substrate. A translucent panel can be used in case it is distinguishable from through holes of the layer by difference in transparency. For an example, a cover layer and/or a base layer can be formed based on a colored acrylic panel.

In general the term 'through hole' can be understood as an hole or an opening penetrating each layer of a message generating panel. The configuration of through holes can be changed. For an example, a through pattern can be formed by a translucent acrylic in an opaque panel layer. The through pattern can mean a part of higher transparency than a base substance of a layer. The 'through hole' is be interchangeable with 'see-through hole' or 'penetrating hole' and the 'through pattern' is interchangeable with 'see-through pattern' or 'penetrating pattern'.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

INDUSTRIAL APPLICABILITY

According to one embodiment of the present invention, a message generating apparatus including a first panel which transmits a incident light partially and a second panel which transmits the light passed through the first panel partially is provided. The projected message can be controlled by illumination condition.

According to one embodiment of the present invention, by utilizing a layer including a through hole from a surface of a message generating panel, a message generating apparatus projecting distinct messages according to illumination angle is provided.

According to one embodiment of the present invention, by overlapping a cover layer and a base layer including through holes, a message generating apparatus representing a message by part of base layer not blocked by the cover layer is provided. With this message generating apparatus, a hidden message not readable from a single layer can be represented.

The invention claimed is:

1. A message generating apparatus, comprising:

a message generating panel, the message generating panel comprising a first layer and a second layer, the first layer comprising a first base substance and a first see-through pattern, a light transparency of the first see-through pattern being higher than a light transparency of the first base substance, the second layer comprising a second base substance and a second see-through pattern, a light transparency of the second see-through pattern being higher than a light transparency of the second base substance, wherein the message generating panel is configured to generate a message by a light having passed through the first see-through pattern and the second see-through pattern, and the first see-through pattern and the second see-through pattern are configured to generate a plurality of messages according to an angle of the light incident to the message generating panel.

2. The apparatus of claim 1, wherein the second see-through pattern of the second layer comprises a first sub see-through pattern and a second sub see-through pattern, the first sub see-through pattern and the second sub see-through pattern corresponding to a first message and a second message respectively, and the message generating panel is configured to generate the first message by a light, incident to the first layer in a first angle, having passed through the first sub see-through pattern and to generate the second message by a light, incident to the first layer in a second angle, having passed through the second sub see-through pattern.

3. The apparatus of claim 1, wherein at least one of the first see-through pattern and the second see-through pattern comprises a hole penetrating through the first base substance or the second base substance in which the see-through patterns are formed.

4. The apparatus of claim 1, wherein the first see-through pattern formed in the first layer comprises a first sub see-through pattern having a inclined central axis to a the first layer.

5. The apparatus of claim 4, wherein the first see-through pattern formed in the first layer comprises a second sub see-through pattern, the second sub see-through pattern having a different central axis inclination angle from the first sub see-through pattern.

6. A message generating apparatus comprising a cover layer and a base layer, the message generating apparatus representing a plurality of messages by overlapping the cover layer and the base layer, the cover layer comprising a first see-through pattern, a light transparency of the first see-through pattern being higher than a light transparency of a base substance of the cover layer, the base layer comprising a message generating panel, the message generating panel comprising a first message pattern and a second message pattern, the first message pattern representing a first message by being exposed through the first see-through pattern in a first overlapping mode with the cover layer, the second message pattern representing a second message by being exposed through the first see-through pattern in a second overlapping mode with the cover layer.

7. The message generating apparatus of claim 6, wherein the first message pattern of the base layer comprises a see-through pattern, a light transparency of the see-through pattern being higher than a light transparency of a base substance of the base layer.

8. The message generating apparatus of claim 6, wherein the first message pattern of the base layer comprises a hole penetrating a base substance of the base layer.

9. The message generating apparatus of claim 6, wherein the first message pattern and the second message pattern of the base layer corresponds to a first part and a second part of a target message and the first message pattern comprises a pattern representing a guide message, the guide message introducing a movement of the base layer and/or the cover layer to convert the message generating panel from the first overlapping mode to the second overlapping mode.

10. A message generating apparatus, comprising a message generating panel, the message generating panel comprising a base substance and a see-through pattern, a light transparency of the see-through pattern being higher than a light transparency of the base substance, wherein the message generating panel is configured to generate a message by a light having passed through the see-through pattern, and the see-through pattern is configured to generate a plurality of messages according to an angle of the light incident to the message generating panel.

11. The apparatus of claim 10, wherein the see-through pattern comprises a through hole penetrating through the base substance in which the see-through pattern is formed.

12. The apparatus of claim 11, wherein the through hole is formed in a plurality of through holes, and some of the plurality of through holes and the rest of the plurality of the through holes are formed at different angles such that a plurality messages are generated according to an angle of incident light.

* * * * *